US012117005B2

(12) United States Patent
Heizinger et al.

(10) Patent No.: US 12,117,005 B2
(45) Date of Patent: Oct. 15, 2024

(54) CARTRIDGE SYSTEM AND ECCENTRIC SCREW PUMP

(71) Applicant: VISCOTEC PUMPEN—U. DOSIERTECHNIK GMBH, Töging a. Inn (DE)

(72) Inventors: Robert Heizinger, Neumarkt-St. Veit (DE); Thomas Huber, Neumarkt-St. Veit (DE); Raphael Lichtnecker, Töging (DE); Stephan Oswald, Egglkofen (DE); Horst Kelsch, Töging (DE); Felix Gruber, Dorfen (DE); Angelo Schulz, Stuttgart (DE); Simon Kasböck, Kastl (DE)

(73) Assignee: VISCOTEC PUMPEN—U. DOSIERTECHNIK GMBH, Töging A. Inn (DE)

( * ) Notice: Subject to any disclaimer, the term of this patent is extended or adjusted under 35 U.S.C. 154(b) by 0 days.

(21) Appl. No.: 18/033,026

(22) PCT Filed: Aug. 11, 2021

(86) PCT No.: PCT/EP2021/072334
§ 371 (c)(1),
(2) Date: Apr. 20, 2023

(87) PCT Pub. No.: WO2022/083913
PCT Pub. Date: Apr. 28, 2022

(65) Prior Publication Data

US 2023/0392594 A1 Dec. 7, 2023

(30) Foreign Application Priority Data

Oct. 21, 2020 (EP) ..... 20203116

(51) Int. Cl.
*F04C 2/107* (2006.01)
*F04C 13/00* (2006.01)

(52) U.S. Cl.
CPC ..... *F04C 2/1073* (2013.01); *F04C 2/1071* (2013.01); *F04C 13/00* (2013.01)

(58) Field of Classification Search
CPC ..... F04C 2/1073; F04C 2/1071; F04C 13/00
See application file for complete search history.

(56) References Cited

U.S. PATENT DOCUMENTS

2012/0039734 A1* 2/2012 Sakakihara ..... F04C 2/1073 418/48

FOREIGN PATENT DOCUMENTS

DE 402015202919-0001 6/2017
DE 402015202919-0002 6/2017
(Continued)

OTHER PUBLICATIONS

Machine translation of European Patent Publication EP 3165288 A1, Inventor: Kelsch et al.; Title: Jet Device; Published May 10, 2017. (Year: 2017).*

(Continued)

*Primary Examiner* — Mary A Davis
(74) *Attorney, Agent, or Firm* — Alleman Hall & Tuttle LLP

(57) ABSTRACT

A cartridge system for an eccentric screw pump, comprising a cartridge for receiving a medium to be dosed, a stator being provided on the cartridge, which cooperates with a rotor unit of the eccentric screw pump for dosing the medium, and a plug being movably supported in the cartridge for a fluid-tight closure of the cartridge, wherein the plug comprises a rotor breakthrough through which the rotor unit can be passed.

19 Claims, 23 Drawing Sheets

(56) References Cited

FOREIGN PATENT DOCUMENTS

| | | | |
|---|---|---|---|
| DE | 402015202919-0003 | | 6/2017 |
| DE | 402015202919-0004 | | 6/2017 |
| DE | 102018009512 | B3 | 11/2019 |
| EP | 2944819 | A1 | 11/2015 |
| EP | 3165288 | A1 | 5/2017 |

OTHER PUBLICATIONS

Tytgat, J., German Design Application No. XP93013541, Filed Aug. 26, 2015, 21 pages.
European Patent Office, Office Action Issued in Application No. 20203116.7, Jun. 21, 2023, Germany, 16 pages.

* cited by examiner

CARTRIDGE SYSTEM AND ECCENTRIC SCREW PUMP

FIELD

The present invention relates to a cartridge system for an eccentric screw pump and to an eccentric screw pump, in particular a 3D print head, comprising such a cartridge system.

BACKGROUND

Eccentric screw pumps include a stator and a rotor rotating within the stator. When the rotor rotates, a medium to be dosed is conveyed by the interaction of the rotor with the stator in a longitudinal direction of the eccentric screw pump away from a drive device of the eccentric screw pump according to the endless piston principle. The delivery volume per unit of time depends on the speed, size, pitch and geometry of the rotor. With such eccentric screw pumps, high-precision dosing processes with a high repeat accuracy are possible. For this reason, eccentric screw pumps are suitable for use as print heads for additive or generative manufacturing.

SUMMARY

In additive manufacturing or 3D printing, a component is built up layer by layer from a liquid, powdery or paste-like material or medium. If, for example, different formulations of the medium to be printed are tested, it is usually necessary to disassemble the entire eccentric screw pump, which is labor-intensive and time-consuming, and to clean its components in contact with the medium, such as the rotor and the stator. It is therefore desirable that the eccentric screw pump can be cleaned as easily and quickly as possible.

Against this background, one object of the present invention is to provide an interchangeable cartridge system for an eccentric screw pump.

Accordingly, a cartridge system for an eccentric screw pump is proposed. The cartridge system comprises a cartridge for receiving a medium to be dosed, a stator being provided on the cartridge, which cooperates with a rotor unit of the eccentric screw pump for dosing the medium, and a plug being movably supported in the cartridge for fluid-tight closure of the cartridge, wherein the plug comprises a rotor breakthrough through which the rotor unit can be passed.

The fact that the movable plug is provided in the cartridge prevents the medium to be dosed from becoming contaminated. On the other hand, it ensures that a drive device of the eccentric screw pump cannot be contaminated with the medium either. Thus, all components in contact with the medium can be replaced by simply replacing the entire cartridge system. Contamination of the drive device is not to be expected. This significantly simplifies cleaning of the eccentric screw pump.

The eccentric screw pump preferably comprises the rotor unit. However, the rotor unit can also be part of the cartridge. The rotor unit includes a bend shaft or flex shaft coupled to the drive device of the eccentric screw pump. The flex shaft may also be referred to as bend shaft or joint shaft. The flex shaft may also be or be referred to as flex rod, particularly plastic flex rod. In this case, the flex shaft may be made of, for example, a polyether ether ketone (PEEK), polyethylene (PE), or the like. A rotor is provided at the front of the flex shaft, which cooperates with the stator.

Preferably, the stator comprises an elastically deformable inner part or elastomer part with a central breakthrough. The breakthrough preferably comprises a helical or worm-shaped inner contour. The stator accommodates the rotatable rotor, which comprises a helical or worm-shaped outer contour corresponding to the inner part. In addition to the replaceable cartridge system, the eccentric screw pump also comprises the aforementioned drive device.

The rotor is driven via the flex shaft by a drive unit, in particular an electric motor, of the drive device. The drive unit drives a drive shaft of the drive device, which is coupled to the rotor unit. The drive shaft may be fixedly connected to the rotor by means of the aforementioned flexible shaft or flex shaft. As the rotor rotates in the stator, the medium is conveyed by interaction with the inner part of the stator in a longitudinal direction of the eccentric screw pump away from the drive shaft according to the endless piston principle. The volume pumped per unit of time depends on the speed, size, pitch and geometry of the rotor.

During operation of the eccentric screw pump, the rotor unit preferably performs an eccentric movement in the rotor breakthrough. However, this is not absolutely necessary. A pure rotational movement could also be provided. In this case, a joint or the previously mentioned flex shaft is to be provided after the plug, i.e. in the medium.

The cartridge is preferably cylindrical. In particular, the cartridge is a disposable syringe. This means that the cartridge system is preferably a disposable item. Alternatively, the cartridge system can be used multiple times. The cartridge preferably has a Luer lock connection on the front. This allows a nozzle to be easily connected to the cartridge. It is also possible to fill the cartridge via the Luer lock connection.

The fact that the stator is "provided" on the cartridge can mean in the present case that the stator is firmly connected to the cartridge. Alternatively, however, the stator can simply be inserted into the cartridge or the like. That is, the stator may also be detachably connected to the cartridge. The plug is linearly movable in the cartridge along the aforementioned longitudinal direction. The plug is tracked by the medium when the medium is dosed. The rotor breakthrough is preferably provided centrally on the plug. The rotor breakthrough can be a stepped bore.

For example, the medium can be an adhesive or sealant, water, an aqueous solution, a paint, a suspension, a viscous raw material, an emulsion, or a grease. The medium may also be a gel or alginate. The medium may comprise cells, in particular human, animal or plant cells. The medium may be a liquid or a paste. By a paste or pasty product is meant a solid-liquid mixture, in particular a suspension, with a high content of solids. For example, the product may have a content of fillers, for example so-called microballoons, fibrous, in particular short-fibered, portions or the like.

The cartridge system or cartridge can include an RFID chip (Radio Frequency Identification). This can be used in particular to recognize the geometry of the stator, for example, in order to be able to assign the appropriate rotor to the stator. Size recognition is thus possible, for example. Furthermore, this also enables batch recognition of the medium contained in the cartridge.

The cartridge system or cartridge can also have a QR code, which is lasered into the cartridge, for example. This can be used, for example, to identify the medium contained in the cartridge. Information can then be read, for example, that allows conclusions to be drawn about the contents of the cartridge, namely the medium. For example, it is possible to identify a batch, make a statement about the service life or shelf life of the medium, track the product or similar.

According to an embodiment, the stator and the cartridge are formed integrally, in particular in one piece of material, or the stator and the cartridge are connected to each other in a form-fit, force-fit and/or material-fit manner.

In the present case, "integral" or "one-piece" means in particular that the stator and the cartridge form a common component and are not composed of different components. "One piece of material" means in the present case that the stator and the cartridge are made of the same material throughout. Alternatively, however, the stator and the cartridge can also be two separate components that are positively, non-positively and/or materially connected to each other.

A form-fit connection is created by the interlocking or rear engagement of at least two connection partners, in this case the stator and the cartridge. For this purpose, latching hooks or the like can be provided on the stator and the cartridge, for example. A non-positive connection requires a normal force on the surfaces to be connected. Force-locking connections can be realized by friction locking. Mutual displacement of the surfaces is prevented as long as the counterforce caused by static friction is not exceeded. For example, the stator is pressed into the cartridge. In the case of materially bonded joints, the joint partners are held together by atomic or molecular forces. Materially bonded connections are non-detachable connections that can only be separated by destroying the connecting means and/or the connecting partners. For example, the stator is glued or vulcanized into the cartridge.

The stator can be formed integrally. However, the stator can also be of two-piece design and has, for example, an inner part made of a silicone, which has the helical breakthrough, and an outer part made of a different plastic material than the inner part. For example, the stator may have an elastomer interior and any thermoplastic exterior. Alternatively, the stator may be made of two different thermoplastics. The stator can have a cone-shaped geometry on the rear side, i.e. facing the plug. However, this is not absolutely necessary.

According to a further embodiment, the rotor breakthrough is closed by means of a membrane facing the stator.

The membrane can be pierced by means of the rotor unit as soon as the cartridge system is mounted on the drive device. For this purpose, the rotor can have a tip with the aid of which the membrane is pierced. Alternatively, the membrane can be pierced with the aid of the rotor unit before the cartridge system is mounted on the drive device. In this case, the rotor unit is connected to the drive device only after the rotor unit has been inserted into the rotor piercing.

According to a further embodiment, the membrane comprises a perforation, wherein the perforation preferably divides the membrane into a plurality of membrane sections.

The number of membrane sections is basically arbitrary. For example, two, three or four membrane sections are provided. The perforation can be used to prevent parts of the membrane from tearing off and contaminating the medium when the membrane is pushed through by the rotor. The perforation ensures that the membrane is torn open evenly. The perforation can, for example, be cross-shaped and have two perforation sections that cross each other.

According to a further embodiment, the plug comprises a pressure ring through which the rotor breakthrough is passed and on which the membrane is provided.

Preferably, the pressure ring has the geometry of a half O-ring. The membrane is connected to the pressure ring integrally, in particular as a single piece of material. The pressure ring runs completely around the rotor unit and constricts around it. This provides a reliable seal of the plug with respect to the rotor unit on the medium side. The pressure ring also acts as a tear stop when the membrane is punctured by means of the rotor unit.

According to a further embodiment, the plug comprises a stiffening ring facing away from the pressure ring, through which the rotor breakthrough is passed.

The stiffening ring preferably has a rectangular geometry in cross section. A rounding is provided at a transition from the stiffening ring into the rotor breakthrough. The rounding facilitates insertion of the rotor unit into the rotor breakthrough.

According to a further embodiment, at least one circumferential annular groove is provided on the rotor breakthrough.

The number of annular grooves is basically arbitrary. For example, two or three annular grooves are provided. The annular grooves together form a labyrinth seal, which provides a reliable seal of the plug against the rotating rotor unit. Furthermore, the annular grooves also serve as a receiving area for displaced material of the plug when the rotor unit performs an eccentric movement in the rotor breakthrough. That is, the plug follows the movement of the rotor unit. This is achieved by selecting an appropriate material for the plug.

According to a further embodiment, the plug facing away from the stator comprises a circumferential first sealing lip, which bears against the inside of the cartridge, and/or the plug facing towards the stator comprises a circumferential second sealing lip which also bears against the inside of the cartridge.

The first sealing lip is preferably pressurized with compressed air and is thus pressed circumferentially against the inside of the cartridge. The second sealing lip ensures, on the one hand, that the plug is sealed radially against the cartridge and, on the other hand, that the medium is wiped off the inside of the cartridge.

According to a further embodiment, the second sealing lip has greater stiffness than the first sealing lip.

"Stiffness" in this context means the resistance of the respective sealing lip to deformation. The stiffness can be influenced, for example, by a suitable geometry or a suitable choice of material. For example, the second sealing lip has a thicker wall than the first sealing lip. This results in a higher stiffness of the second sealing lip.

According to a further embodiment, the first sealing lip extends further out of the plug on the face side than the second sealing lip.

This means that the first sealing lip is higher than the second sealing lip. However, the first sealing lip is preferably thinner-walled than the second sealing lip.

According to a further embodiment, the cartridge system further comprises the rotor assembly passing through the rotor breakthrough.

That is, the rotor unit can be an integral part of the cartridge system. In this case, the rotor unit is detachably connected to the drive device. When the cartridge system is removed from the drive device, the connection between the rotor unit and the drive device is preferably also released at the same time.

According to a further embodiment, the rotor unit is non-detachably connected to the cartridge and/or the plug.

This can prevent the rotor unit from being used more than once. Alternatively, however, the rotor unit can also be detachably connected to the cartridge and the plug. In the latter case, the rotor unit can be used multiple times. For a non-detachable connection of the rotor unit to the cartridge, for example, a lid closing the back of the cartridge can be provided, which has an breakthrough through which the rotor unit is passed. The rotor unit can have latching hooks or snap-in hooks which can be pressed through the breakthrough. As soon as the snap hooks have passed through the breakthrough, the rotor unit is firmly connected to the cartridge and can no longer be separated from it.

According to a further embodiment, the rotor unit is completely encapsulated by the cartridge.

This means, on the one hand, that the rotor unit cannot be separated from the cartridge and, on the other hand, that direct contact of the rotor unit with the drive device is not possible and not necessary. In this case, the rotor unit can be driven by the drive device, for example by means of a magnetic coupling. Encapsulation can be achieved by sealing the cartridge fluid-tight at the rear. A lid can be provided for this purpose.

According to a further embodiment, the rotor unit comprises an interface for coupling the rotor unit to a counter interface of the drive device of the eccentric screw pump.

The interface and the counter interface are used to transmit torque from the drive device to the rotor unit. The interface can, for example, have two key surfaces arranged parallel to each other. In this case, the counter interface has two corresponding key surfaces. The rotor unit may be rectangular, star-shaped, triangular or square in cross-section, as well as round. The interface and the counter interface may include magnets to implement the aforementioned magnetic coupling.

According to a further embodiment, the interface comprises a latching lug that latches into the counter interface when the rotor unit is connected to the drive device.

The latching lug thus provides a positive connection between the rotor unit and the counter interface. The counter interface is provided on the drive shaft of the drive device. In the event that the cartridge system is a disposable article, the latching lug is designed in such a way that it shears off or breaks off when the rotor unit is separated from the drive device. That is, the rotor unit can no longer be connected to the drive device. Alternatively, the latching lug can also deform elastically. In this case, the rotor unit can be used several times.

According to a further embodiment, the interface comprises a plurality of elastically deformable arm sections on which the latching lug is provided.

For example, two or four arm sections are provided. The number of arm sections is basically arbitrary. Slots are provided between the arm sections. This results in a slot-shaped or cross-slot-shaped geometry. Alternatively, the interface can also have a polygonal, rectangular, triangular or star-shaped geometry.

According to a further embodiment, the cartridge system further comprises the medium being received in the cartridge.

For example, the medium may be an alginate, bone wax, or any other biological or medical material. The medium may include human, animal, or plant cells. The medium may further include bacteria or viruses. Depending on the use of the cartridge system in biomedical, pharmaceutical or industrial applications, a suitable medium may be selected. The medium can also be a cyanoacrylate, for example.

According to a further embodiment, the plug comprises an indicator that changes state after a use of the cartridge system.

In particular, the indicator changes its state after a single use of the cartridge system. For example, the indicator may be a dye. The change in state may be a change in color. The state may change as a result of the indicator being exposed to light and/or moisture. Thus, the indicator can be used to indicate that the cartridge system has already been used once. Further, the indicator may also change state only after a predetermined time. Furthermore, the indicator may also be designed to change its state only after a predetermined number of uses of the cartridge system.

According to a further embodiment, the plug is made of an air-permeable or air-impermeable material.

In the case that the plug is made of an air-permeable material, degassing of the medium is possible under the pressure of the plug on the medium. This is particularly important when processing liquid silicones or acrylates. Thus, bubbles formed in the medium can pass through the air-permeable material. For this purpose, the plug consists of a porous, open-pore gas-permeable material. For example, polytetrafluoroethylene (PTFE), polyethylene (PE) or another suitable material can be used. This allows gas bubbles trapped in the medium to escape via the porous material. The porosity of the material is selected, for example, in the range from 1 μm to 50 nm, preferably in the range from 10 μm to 50 nm, more preferably in the range from 20 μm to 50 nm. Thus, the viscous medium cannot escape through the plug. Alternatively, the plug can also have a built-in air-permeable membrane.

Furthermore, an eccentric screw pump, in particular a 3D print head, with a drive device and such an exchangeable cartridge system is proposed, which is detachably connected to the drive device.

A bayonet lock, for example, can be provided for detachable connection of the cartridge system to the drive device. The medium is pressurized via the plug with the aid of compressed air or a spring element. Furthermore, an eccentric insert can also be provided in the plug. The pitch of this insert is adapted to the volumetric quantity and thus also to the plug speed. A spindle drive is thus realized. The plug is then positively controlled and thus follows the medium.

The eccentric screw pump can be mains operated. However, the eccentric screw pump can also be battery-powered. This makes the eccentric screw pump independent of a power supply. The eccentric screw pump can thus operate autonomously as a hand-held device. For example, the eccentric screw pump can thus be used to dose solder paste at a manual workstation. The eccentric screw pump can thus be used in the manner of a pipetting device or pipetting aid, with the difference that with the aid of the eccentric screw pump, high-viscosity media can preferably also be dosed. Furthermore, such a self-sufficiently operating eccentric screw pump can also be used for rapid wound care, for example for field care of emergency personnel, or in the operating room. In this case, for example, waxes, in particular bone waxes, adhesives, dental prosthesis materials, artificial skin or the like can be dosed.

In the present context, "one" is not necessarily to be understood as being limited to exactly one element. Rather, several elements, such as two, three or more, may also be provided. Also, any other counting word used herein is not to be understood as limiting to exactly the number of elements mentioned. Rather, numerical deviations upwards and downwards are possible, unless otherwise indicated.

Further possible implementations of the cartridge system and/or the eccentric screw pump also include combinations of features or embodiments described previously or below with regard to the embodiment examples that are not explicitly mentioned. In this context, the skilled person will also add individual aspects as improvements or additions to the respective basic form of the cartridge system and/or the eccentric screw pump.

Further advantageous embodiments and aspects of the cartridge system and/or the eccentric screw pump are the subject of the subclaims as well as the embodiment example of the cartridge system and/or the eccentric screw pump described below. Furthermore, the cartridge system and/or the eccentric screw pump are explained in more detail on the basis of preferred embodiments with reference to the attached figures.

DETAILED DESCRIPTION

In the figures, identical or functionally identical elements have been given the same reference signs unless otherwise indicated.

Figure 1:
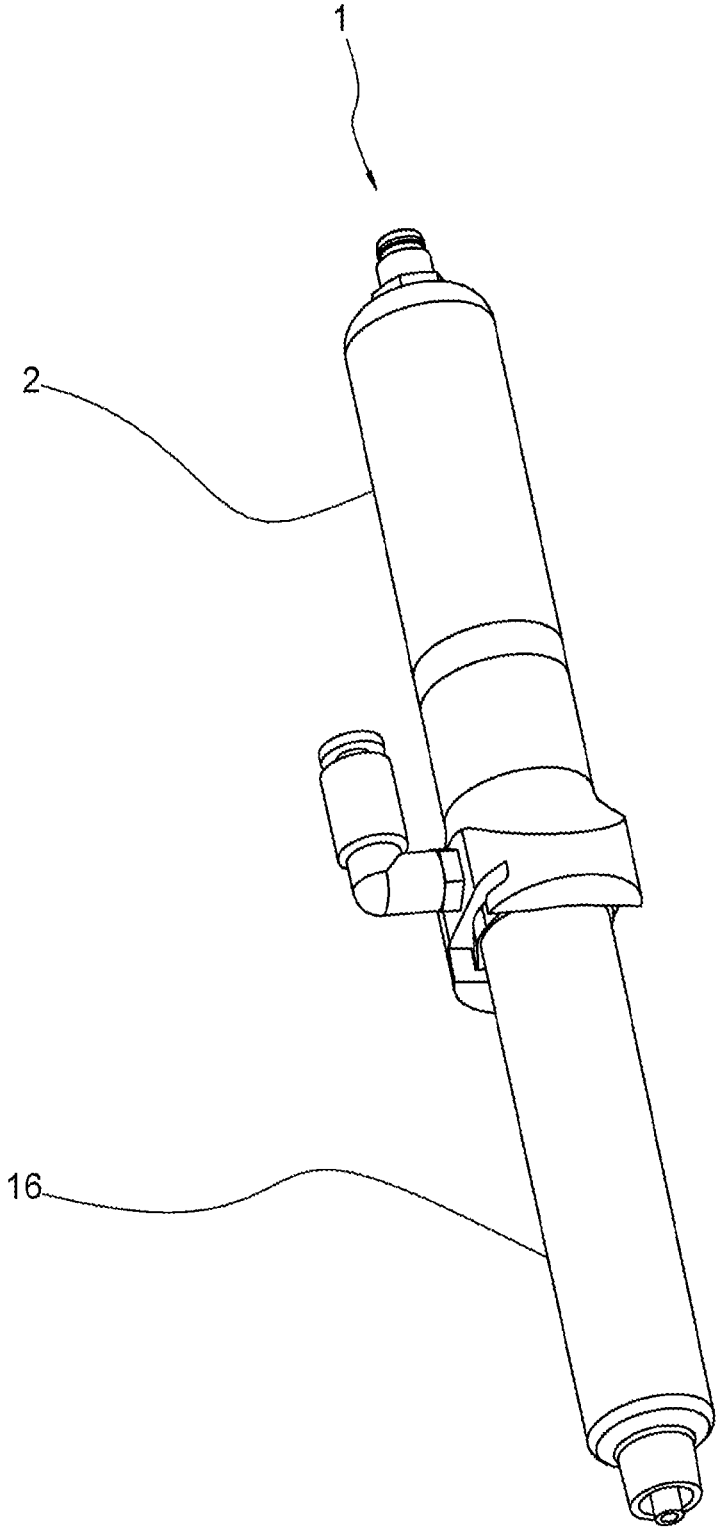
FIG. 1 shows a schematic perspective view of an embodiment of an eccentric screw pump.
Figure 2:
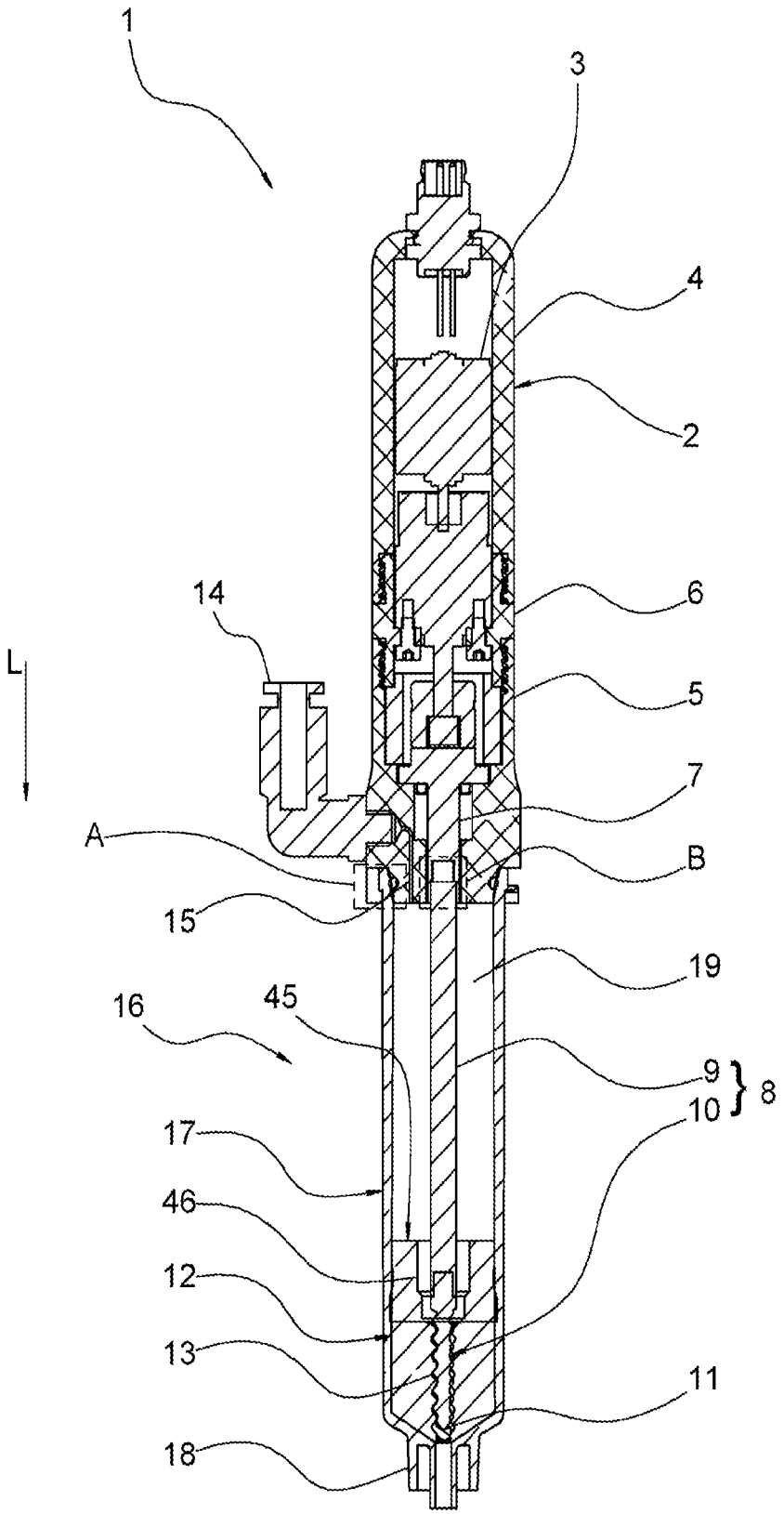
FIG. 2 shows a schematic sectional view of the eccentric screw pump according to FIG. 1.
Figure 3:
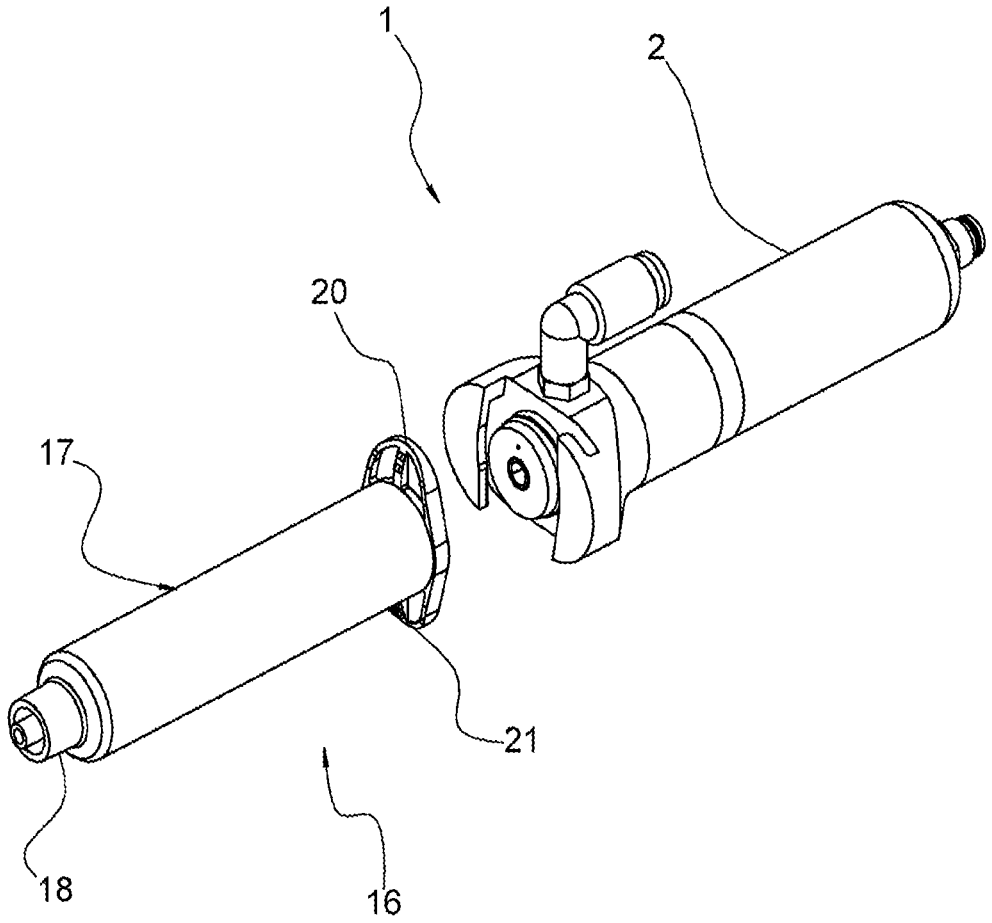
FIG. 3 shows another schematic perspective view of the eccentric screw pump according to FIG. 1.
Figure 4:
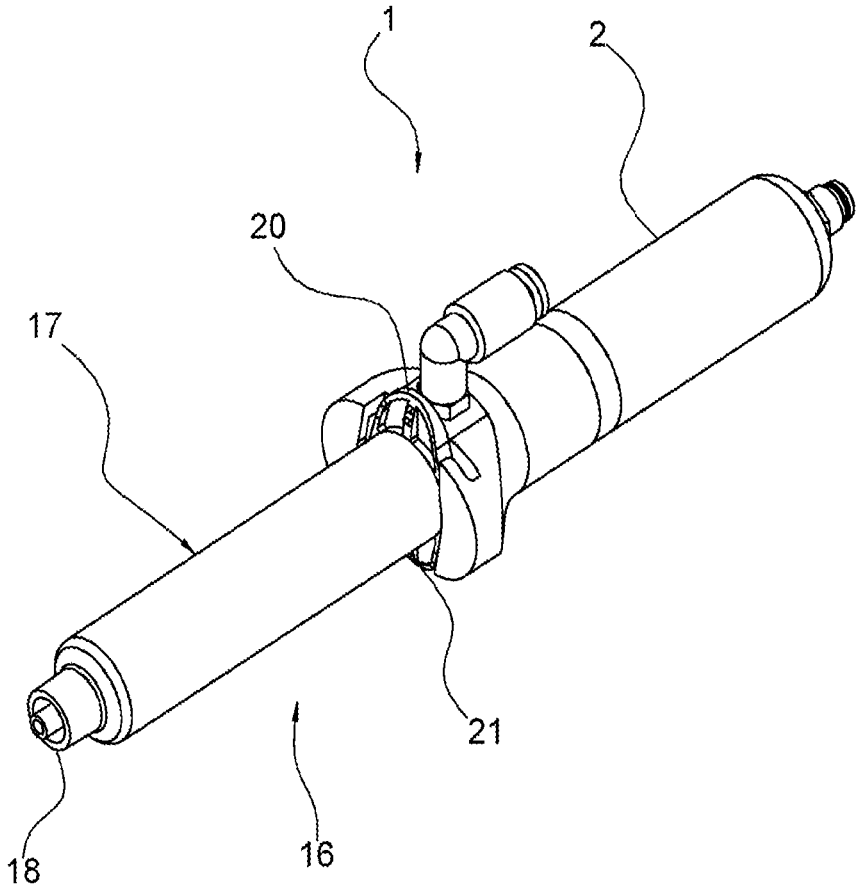
FIG. 4 shows another schematic perspective view of the eccentric screw pump according to FIG. 1.
Figure 5:
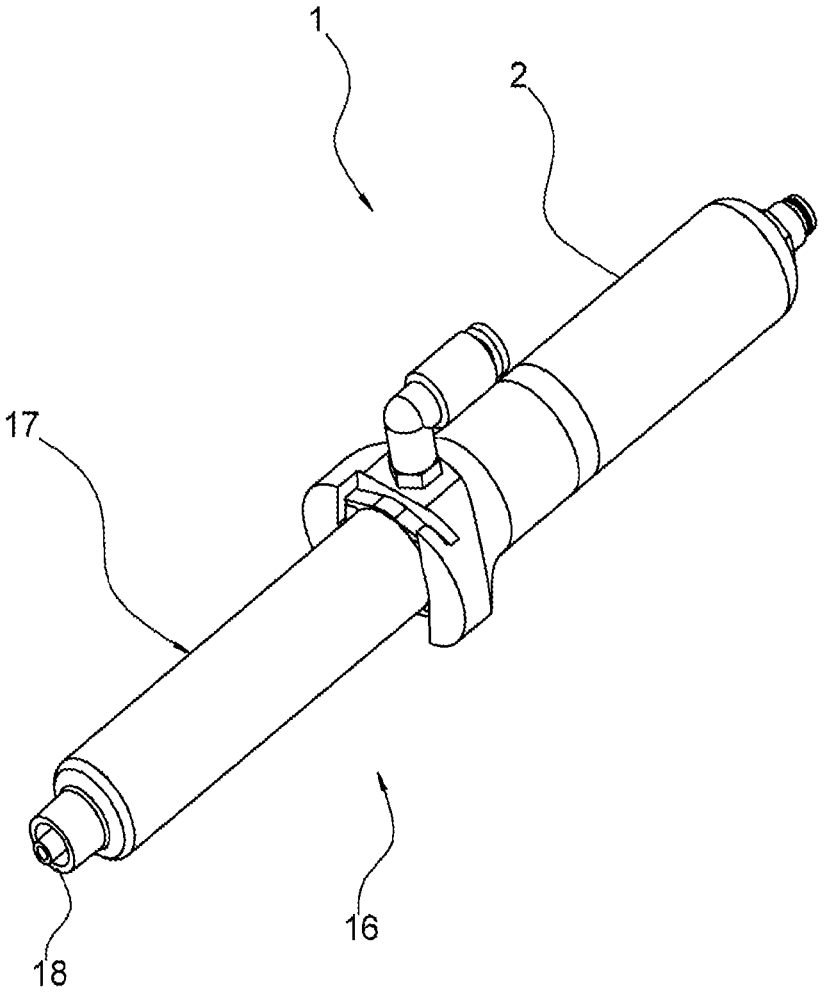
FIG. 5 shows another schematic perspective view of the eccentric screw pump according to FIG. 1.

FIG. 1 shows a schematic perspective view of an embodiment of an eccentric screw pump 1 for dosing a liquid or pasty medium. FIG. 2 shows a schematic sectional view of the eccentric screw pump 1. FIG. 3 shows a further schematic perspective view of the eccentric screw pump 1. FIG. 4 shows a further schematic perspective view of the eccentric screw pump 1. FIG. 5 shows a further schematic perspective view of the eccentric screw pump 1. In the following, reference is made to FIGS. 1 to 5 simultaneously.

The eccentric screw pump 1 comprises a drive device 2. The drive device 2 comprises a drive unit 3, which may comprise an electric motor. The drive unit 3 is accommodated in a housing 4. The housing 4 may be tubular. A bearing housing 5 is attached to a front face of the housing 4. The bearing housing 5 may, for example, be screwed to the housing 4 by means of a connection element 6.

The drive unit 3 drives a drive shaft 7 of the drive device 2. The drive shaft 7 in turn drives a rotor unit 8. The rotor unit 8 comprises a bend shaft or flex shaft 9, which is coupled to the drive shaft 7 by means of an interface, and a worm-shaped rotor 10, which is attached to a front face of the flex shaft 9. The rotor 10 is thus driven by the flex shaft 9.

The flex shaft 9 is elastically deformable and enables eccentric movement of the rotor 10. The flex shaft 9 serves to transmit torque from the drive unit 3 to the rotor 10. The flex shaft 9 can be a wire rope which is coated or sheathed with a plastic material, for example. Instead of the flex shaft 9, a universal joint or cardan joint may also be provided, which also allows eccentric movement of the rotor 10. The flex shaft 9 may also be or be designated as a flex rod, in particular a plastic flex rod. In this case, the flex shaft 9 may, for example, be made of a polyether ether ketone (PEEK), polyethylene (PE) or the like. The flex shaft 9 may have a diameter of 3 mm, for example. The rotor 10 comprises a tip 11 at a front side thereof.

The rotor 10 and the flex shaft 9 can, for example, be formed integrally, in particular in one piece of material. "Integral" or "one-piece" means in the present case that the flex shaft 9 and the rotor 10 form a common component and are not composed of different components. "One piece of material" means in the present case that the flex shaft 9 and the rotor 10 are made of the same material throughout. Preferably, the rotor unit 8 is a plastic component. For example, the rotor unit 8 can be an integral injection-molded plastic component.

Alternatively, the flex shaft 9 and the rotor 10 can also be two separate components that are, for example, inserted into each other and thus either detachably or non-detachably connected to each other. For example, the flex shaft 9 can be made of a metallic material and the rotor 10 can be made of a plastic. The flex shaft 9 may be sheathed with an elastomer. The rotor 10 may also be made of a metallic material. For example, the rotor 10 may be made of stainless steel. However, the rotor 10 may also be a plastic component or a ceramic component and may have a wide variety of coatings.

The eccentric screw pump 1 further comprises a preferably at least partially elastically deformable stator 12. In particular, the stator 12 is an elastically deformable elastomeric part comprising a central breakthrough 13. The breakthrough 13 preferably comprises a helical or worm-shaped inner contour. The stator 12 accommodates the rotatable rotor 10, which comprises a helical or worm-shaped outer contour corresponding to the stator 12. An air supply 14 is provided on the bearing housing 5, which is in fluid communication with an air duct 15 provided in the bearing housing 5 and leading out of an end face of the bearing housing 5.

When the rotor 10 rotates, the medium is conveyed away from the drive shaft 7 according to the endless piston principle through the interaction with the breakthrough 13 of the stator 12 in a longitudinal direction L, which is oriented from the drive device 2 in the direction of the rotor 10. The volume conveyed per unit of time depends on the speed, size, pitch and geometry of the rotor 10.

Eccentric screw pumps 1 are particularly suitable for pumping a wide range of media, especially viscous, highly viscous and abrasive media. The eccentric screw pump 1 belongs to the group of rotating displacement pumps. The main parts of the eccentric screw pump 1 are the drive device 2, the rotatable rotor 10 and the stationary stator 12, in which the rotor 10 rotates. The rotor 10 is designed as a type of round thread screw with an extremely large pitch, a large pitch depth and a small core diameter.

The at least partially elastically deformable stator 12 preferably has one more thread than the rotor 10 and twice the pitch length of the rotor 10. This leaves conveying spaces between the stator 12 and the rotor 10 rotating therein and additionally moving radially, which move continuously from an inlet side of the stator 12 to an outlet side thereof. Valves for limiting the conveying spaces are not required. The size of the delivery spaces and thus the theoretical flow rate depends on the pump size. A 360° rotation of the rotor unit 8 with free discharge gives the volumetric delivery rate per revolution. The pump delivery rate can thus be varied via the rotational speed. The actual flow rate is dependent on a back pressure that sets in.

The medium to be dosed is always trying to achieve a pressure balance from high to low pressure. Since the seal between the rotor 10 and the stator 12 is not static, medium will always flow from the pressure side to the suction side. These "slip losses" can be seen from a characteristic curve as the difference between the theoretical and the actual flow rate.

The shape of the pumping chambers is constant, so that the medium is not compressed. With a suitable design, this type of eccentric screw pump 1 can therefore be used to convey not only fluids but also solids. The shear forces acting on the material to be conveyed are very small, so that, for example, plant, animal and human cells can also be conveyed without destruction. A particular advantage of such an eccentric screw pump 1 is that it conveys continuously and with low pulsation. This makes it suitable for use in potting systems. Even highly viscous and abrasive media can be conveyed without any problems.

The eccentric screw pump 1 can therefore be used to convey a wide variety of media gently and with low pulsation. The spectrum of media ranges from water to media that no longer flow by themselves. Since the flow rate is proportional to the speed of the rotor 10, the eccentric screw pump 1 can be used very well for dosing tasks in conjunction with appropriate measurement and control technology.

The eccentric screw pump 1 combines in itself many positive characteristics of other pump systems. Like the centrifugal pump, the eccentric screw pump 1 has no suction and discharge valves. Like the piston pump, the eccentric screw pump 1 has an excellent self-priming capacity. Like the membrane or peristaltic pump, the eccentric screw pump 1 can pump any type of inhomogeneous and abrasive media, even mixed with solids and fibers.

Multiphase mixtures are also conveyed safely and gently by the eccentric screw pump 1. Like the gear or screw pump, the eccentric screw pump 1 is capable of handling the highest viscosities of the medium. Like the piston, membrane, gear or screw pump, the eccentric screw pump 1 has a speed-dependent, continuous flow rate and is thus able to perform high-precision dosing tasks.

The eccentric screw pump 1 can basically be used in all industrial sectors in which special conveying tasks have to be solved. Examples include environmental engineering, in particular conveying in the area of sewage treatment plants, the food industry, in particular for highly viscous media, such as syrup, curd, yogurt and ketchup, in the various low-germ processing stages, and the chemical industry, in particular for the safe conveying and dosing of aggressive, highly viscous and abrasive products.

The eccentric screw pump 1 can therefore be used for precise dosing of a wide variety of media. A repeat accuracy of up to ±1% can be achieved. Various embodiments of the eccentric screw pump 1 also enable the dispensing of two-component media. Due to its design, namely that the rotor 10 moves in the medium and the inner volume of the suction side must be filled, such an eccentric screw pump 1 always has a certain dead space.

As mentioned before, the rotor unit 8 comprises the flex shaft 9, which is elastically deformable. This allows the eccentric movement of the rotor 10 in the stator 12. It is also possible to realize this eccentric movement by means of joints, in particular universal joints or cardan joints. The stator 12 is subjected to a continuous load during operation, which is why it is subject to wear. This wear is compensated for by regular replacement of the stator 12, the replacement intervals being determined by the media used and the process parameters.

In such an eccentric screw pump 1, the medium to be conveyed has so far always been supplied from outside the eccentric screw pump 1. Cartridges, hoses or the like can be provided for this purpose. The sealing of the drive shaft 7 takes place at an interface of the same with the drive unit 3 and must at least withstand the feed pressure or the pressure which is generated by a reverse running of the drive device 2. The eccentric screw pump 1 is cleaned both by flushing with cleaning fluid and by disassembly and manual cleaning. In many cases, heating or cooling of the eccentric screw pump 1 is possible.

In addition to the drive device 2, the eccentric screw pump 1 comprises a cartridge system 16, which is detachably connected to the drive device 2. The cartridge system 16 comprises a cartridge 17, which is designed as a plastic component, in particular as an injection-molded plastic component. The cartridge 17 has, for example, the shape of a disposable syringe. The cartridge 17 has a Luer lock connection 18 on a front face thereof. The rotor unit 8 can be part of the cartridge system 16.

The cartridge 17 encloses a cylindrical interior space 19 in which the medium, to be explained later, is received. The interior space 19 is, or may be described as, a cartridge interior space. The air duct 15 also opens into the interior space 19. That is, the air supply 14 is in fluid communication with the interior space 19 via the air duct 15 provided in the bearing housing 5, which leads out of an end face of the bearing housing 5.

The stator 12 is accommodated in the interior space 19. The stator 12 can be formed integrally, in particular one piece of material, with the cartridge 17. For example, the cartridge 17 and the stator 12 form an integral, in particular a one piece of material, injection-molded plastic component. However, the stator 12 may also be made of a material different from the cartridge 17. For example, the stator 12 is made of a liquid silicone rubber or LSR, any elastomer, an engineering plastic, or the like.

The stator 12 can be molded onto the cartridge 17 using a plastic injection molding process. A two-component plastic injection molding process can be used for this purpose, for example. However, the stator 12 can also, for example, merely be pressed into the cartridge 17 and thus be connected to it in a force-fit and/or form-fit manner. A positive connection is created by the interlocking or rear engagement of at least two connection partners, in this case the stator 12 and the cartridge 17. For this purpose, snap-in hooks or latching hooks can be provided on the stator 12 and/or the cartridge 17, for example.

A frictional connection, on the other hand, requires a normal force on the surfaces to be connected. Frictionally engaged connections can be realized by frictional locking. Mutual displacement of the surfaces is prevented as long as the counterforce caused by static friction is not exceeded. Preferably, the stator 12 is pressed into the cartridge 17 in this case.

The stator 12 can also be materially bonded to the cartridge 17. This can be done, for example, by the two-component plastic injection molding process mentioned previously. In the case of materially bonded connections, the connecting partners are held together by atomic or molecular forces. Materially bonded connections are non-detachable connections that can only be separated by destroying the connecting means and/or the connecting partners. For example, the stator 12 may be glued into the cartridge 17.

Figure 7:
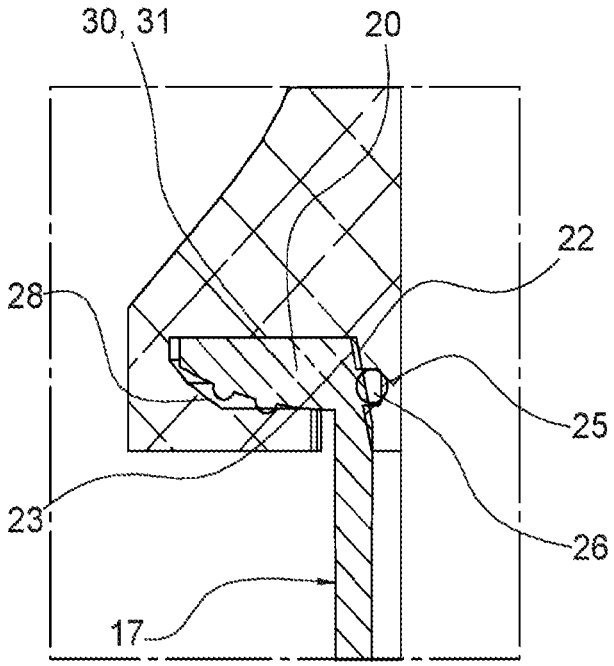
FIG. 7 shows the detailed view A according to FIG. 2.

The stator 12 is provided a the front face of the cartridge 17. Facing away from the Luer lock connection 18, the cartridge 17 comprises two arm sections 20, 21, which can be brought into positive engagement with the bearing housing 5 in order to connect the cartridge system 16 to the drive device 2. Furthermore, facing away from the Luer lock connection 18, the cartridge 17 comprises a cone-shaped engagement section 22 (FIG. 7).

Figure 6:
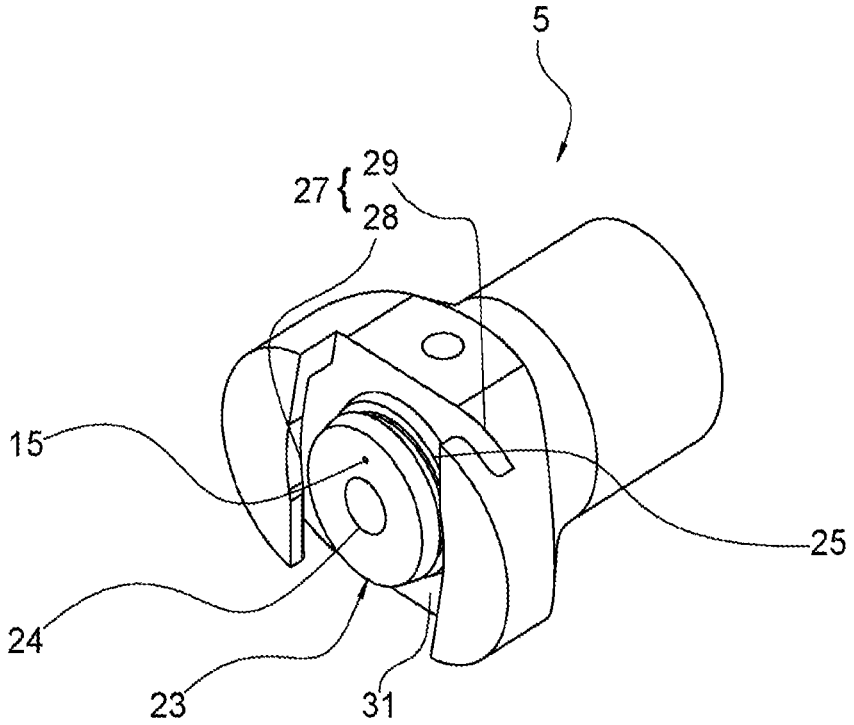
FIG. 6 shows a schematic perspective view of an embodiment of a bearing housing for the eccentric screw pump according to FIG. 1.

As shown in FIG. 6, the bearing housing 5 includes a cone-shaped counter engagement section 23 adapted to engage the engagement section 22. The cone-shaped counter engagement section 23 includes a central breakthrough 24 through which the drive shaft 7 is passed. On the outside, an annular groove 25 runs around the counter engagement section 23, in which an O-ring 26 (FIG. 7) is accommodated. The bearing housing 5 further comprises a bayonet lock 27, which allows the cartridge system 16 to be easily and quickly connected to the drive device 2. The bayonet lock 27 comprises two slot-shaped recesses 28, 29 provided on the bearing housing 5.

As shown in FIGS. 3 to 5, the cartridge system 16 is first fitted onto the cone-shaped counter engagement section 23, causing it to engage with the engagement section 22 of the cartridge 17. Subsequently, the cartridge system 16 is rotated clockwise by 90° with respect to the drive device 2. Here, the arm sections 20, 21 come into engagement with the recesses 28, 29 of the bayonet lock 27, whereby the engagement section 22 of the cartridge 17 is pushed further onto the counter engagement section 23 until the O-ring 26 seals against the cartridge 17 and until front faces 30 (FIG. 7) of the arm sections 20, 21 rest against an front face 31 (FIGS. 6 and 7) of the bearing housing 5. The O-ring 26 is thereby compressed, whereby a fluid-tight seal of the bearing housing 5 with respect to the cartridge 17 is achieved. "Fluid-tight" in the present context means in particular both gas-tight and liquid-tight. The interior space 19 of the cartridge 17 can now be pressurized via the air duct 15.

By sealing the cartridge system 16 by means of the O-ring 26 to the cone-shaped counter engagement section 23, it is possible to easily mount the cartridge system 16 to the drive device 2. When the cartridge system 16 is rotated with respect to the bearing housing 5, the cartridge system 16 is pulled against the bearing housing 5 due to the bayonet lock 27 and thus seals with respect to the cartridge 17 with the aid of the O-ring 26. The cone-shaped counter engagement section 23 further enables the cartridge system 16 to be centered against the bearing housing 5.

The counter engagement section 23 thus fixes the cartridge system 16 to the drive device 2. The use of the bayonet lock 27 reliably prevents unintentional detachment of the cartridge system 16 from the drive device 2. Sealing is achieved by means of the conical engagement section 22 and the conical counter engagement section 23 as well as the O-ring 26. With the aid of the bayonet lock 27, uniform pressure can be applied to the cartridge 17 so that the front faces 30, 31 are pressed against each other. The geometry of the counter engagement section 23 is adapted to the engagement section 22 of the cartridge 17.

Figure 8:
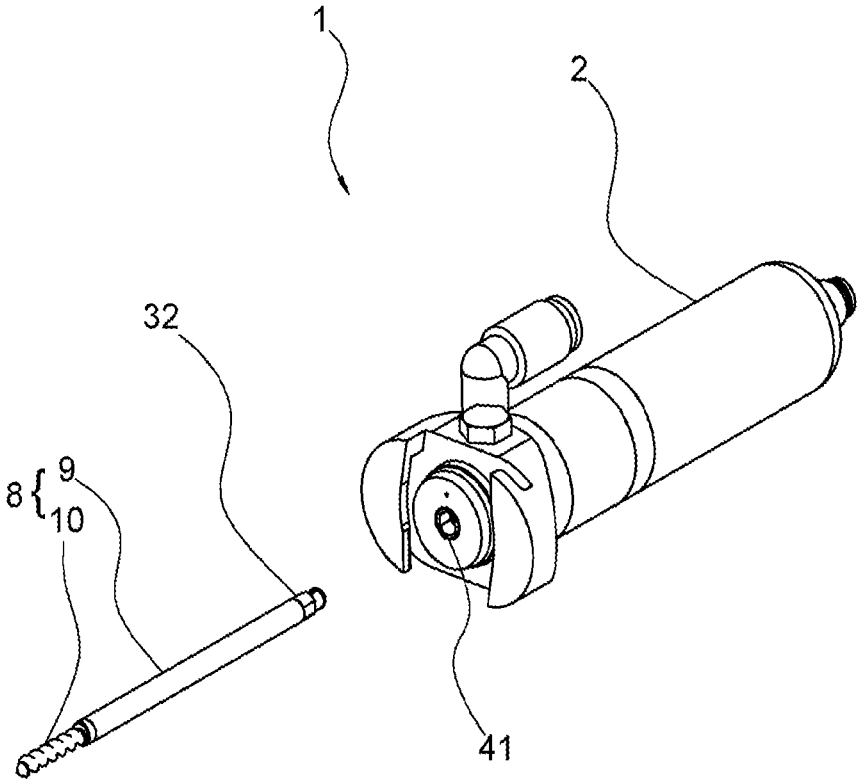
FIG. 8 shows another schematic perspective view of the eccentric screw pump according to FIG. 1.
Figure 10:
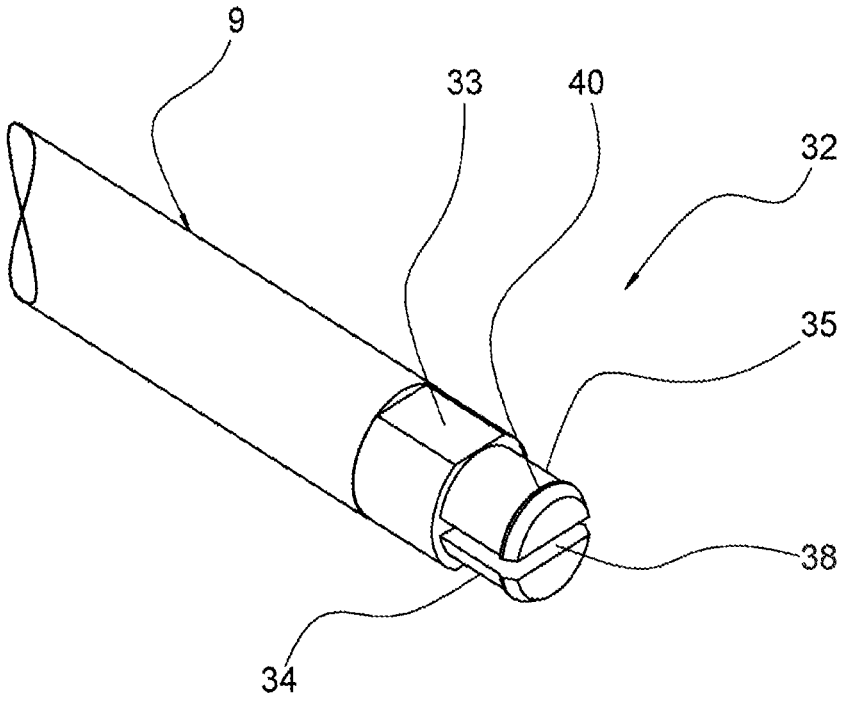
FIG. 10 shows a schematic perspective view of an embodiment of an interface of a rotor unit for the eccentric screw pump according to FIG. 1.
Figure 11:
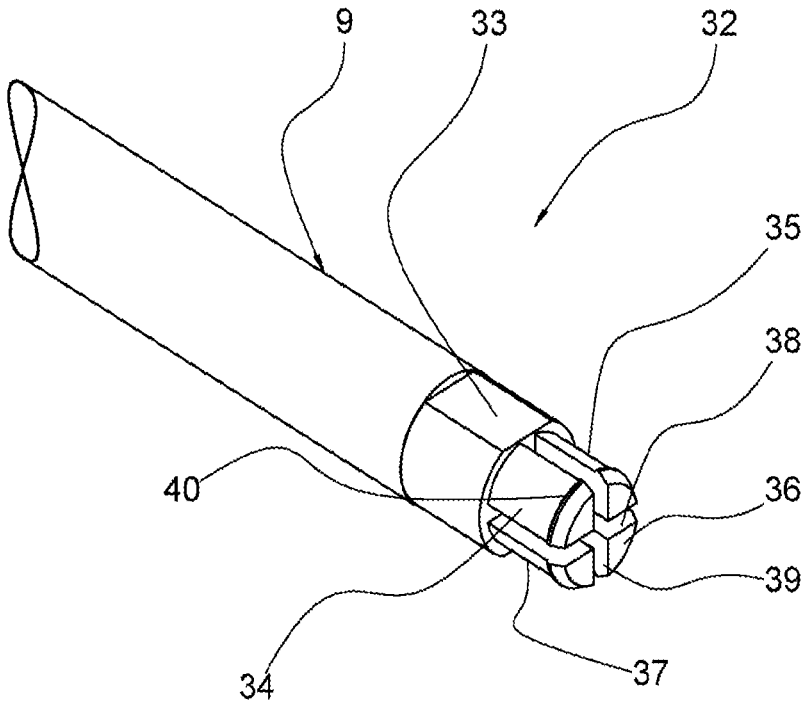
FIG. 11 shows a schematic perspective view of a further embodiment of an interface of a rotor unit for the eccentric screw pump according to FIG. 1.

FIG. 8 shows another schematic perspective view of the eccentric screw pump 1, whereby the cartridge 17 is not shown. As previously mentioned, an interface 32 (FIGS. 10 and 11) is provided between the rotor unit 8, in particular the flex shaft 9, and the drive shaft 7. As shown in FIGS. 10 and 11, the interface 32 comprises two key surfaces 33 arranged opposite each other and a plurality of elastically deformable arm sections 34, 35. In this regard, as shown in FIG. 10, two such arm sections 34, 35 may be provided.

However, as FIG. 11 shows, four arm sections 34 to 37 can also be provided, for example. Slots 38, 39 are provided between the arm sections. This allows elastic deformation of the arm sections 34 to 37. An annular, circumferential latching lug 40 is provided on the arm sections 34 to 37. The latching lug 40 is interrupted at the slots 38, 39. The provision of two slots 38, 39 or of four arm sections 34 to 37 is optional and is particularly suitable for rotor units 8 which are made of a harder plastic.

Figure 12:
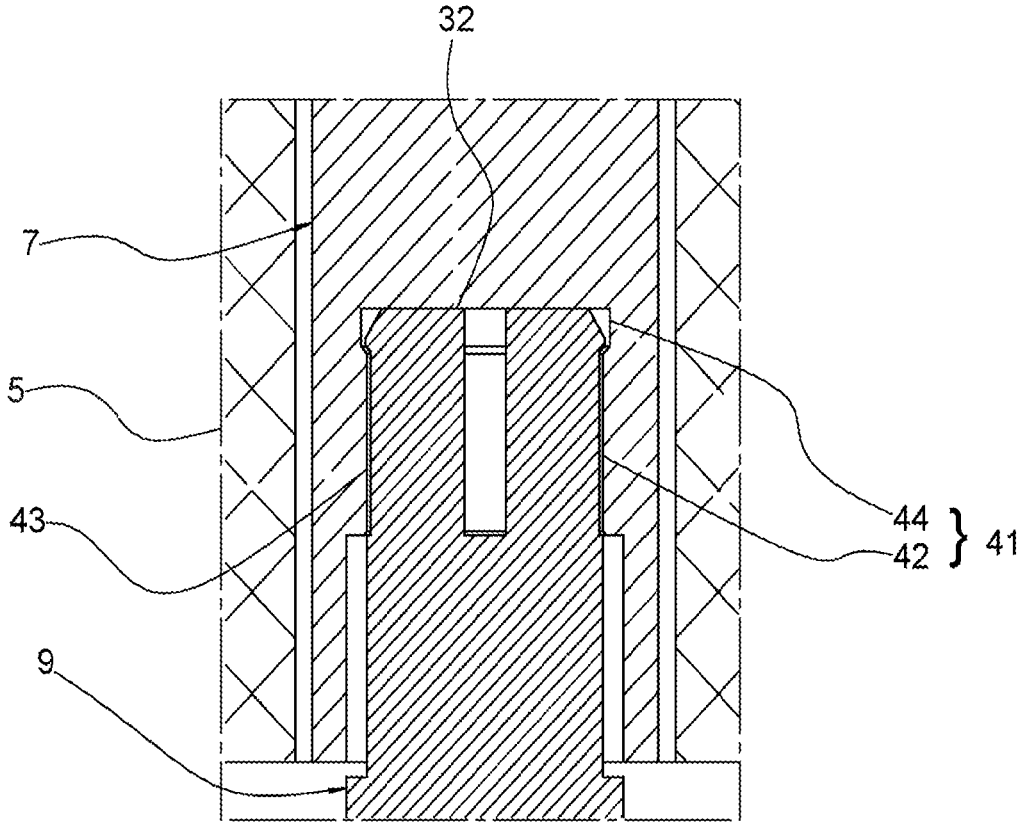
FIG. 12 shows the detailed view B according to FIG. 2.

As shown in FIG. 12, the drive shaft 7 comprises a counter interface 41 corresponding to the interface 32. The counter interface 41 comprises key surfaces 42, 43 corresponding to the key surfaces 33. The key surfaces 33 and the key surfaces 42, 43 serve to transmit torque from the drive shaft 7 to the flex shaft 9. The counter interface 41 further comprises a shoulder 44, which is formed as a circumferential annular groove. The latching lug 40 engages positively in the shoulder 44.

Figure 9:
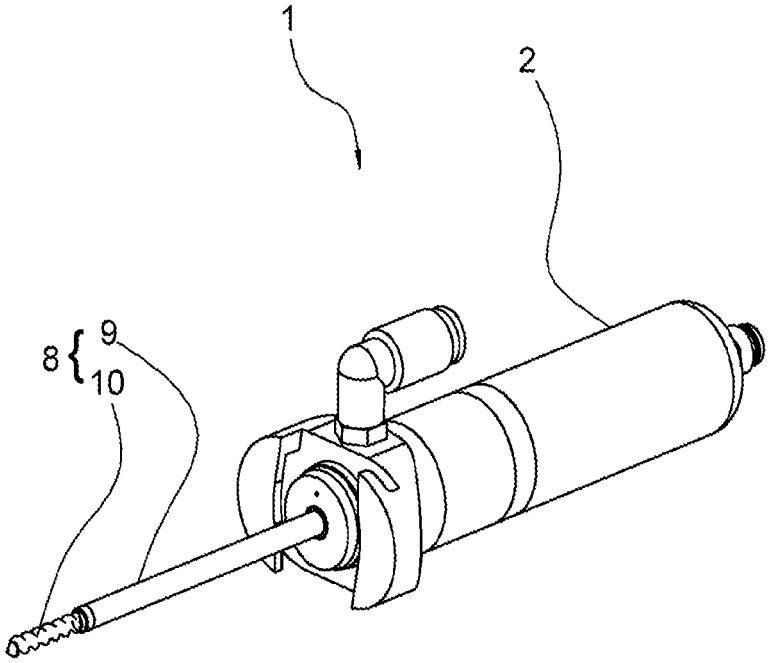
FIG. 9 shows another schematic perspective view of the eccentric screw pump according to FIG. 1.

To connect the rotor unit 8 to the drive device 2, the interface 32 of the rotor unit 8 is inserted into the counter interface 41 of the drive shaft 7, as shown in FIGS. 8 and 9. In the process, the arm sections 34 to 37 of the interface 32 deform resiliently until the latching lug 40 engages positively in the shoulder 44 of the counter interface 41. To separate the rotor unit 8 from the drive device 2, the rotor unit 8 is pulled out of the drive shaft 7 so that the interface 32 and the counter interface 41 separate from each other.

In this case, in the event that the rotor unit 8 is a disposable item, the latching lug 40 can be sheared off or break off from the interface 32. This makes it impossible to reconnect the rotor unit 8 to the drive device 2. In the event that the rotor unit 8 is used several times, the arm sections 34 to 37 deform resiliently when the rotor unit 8 is pulled out of the drive shaft 7, so that the latching lug 40 comes out of positive engagement with the shoulder 44 of the counter interface 41. The rotor unit 8 can now be pulled off the drive device 2. Since the latching lug 40 does not shear off in this case, the rotor unit 8 can also be used several times.

Now returning to FIG. 2, the cartridge system 16 comprises a plug 45 received in the cartridge 17. The plug 45 is linearly slidable along the longitudinal direction L in the cartridge 17. That is, the plug 45 can move within the cartridge 17 along the longitudinal direction L and against the longitudinal direction L. The rotor unit 8, in particular the rotor 10, is passed through the plug 45. For this purpose, a rotor breakthrough 46 breaking through the plug 45 is provided.

The cartridge system 16 with the cartridge 17, the stator 12 and the plug 45 preferably forms a disposable or a single-use article. The cartridge system 16 can thereby also comprise the rotor unit 8, in particular the rotor 10. However, this is not absolutely necessary. Alternatively, the cartridge system 16 can also be used multiple times. In the latter case, the cartridge system 16 can be refilled.

Single-use process solutions, also known as single-use technologies, are used in particular for the manufacture of biopharmaceutical products. This refers to complete solutions consisting of single-use systems, which are also referred to as single-use systems, for an entire process line. This can include, for example, media and buffer production, bioreactors, cell harvesting, depth filtration, tangential flow filtration, chromatography and virus inactivation.

Various defined media are required for biotechnical processes. These include nutrient solutions, cells, buffers for pH stabilization, and acids and bases for adjusting and regulating the pH value during cultivation. All media used must be sterilized before use. Two main methods are used for this purpose in biotechnology, heat sterilization at at least 121° C. at 1 bar overpressure for at least 20 min and sterile filtration. For media containing heat-sensitive components such as vitamins, proteins and peptides, sterile filtration is the method of choice.

The difference between disposable media and buffer production and conventional processes lies in the use of corresponding disposable products, which are specially developed for this purpose, for example, special bags, disposable mixing systems and filters, and corresponding pumps. In contrast to conventional filters, the filters used are pre-sterilized. In some cases, bags, filters and pump heads are already connected together as a complete disposable system. The entire system is supplied connected and pre-sterilized to avoid contamination. In addition to the aforementioned single-use processes, each of which is based on a basic procedural operation, special methods and equipment have been developed in the world of biopharmaceutical single-use production that are predominantly used only here, such as sterile couplings and tube welding equipment.

The available single-use process solutions are each to be regarded as a self-contained module. Within the scope of a single-use production process, the basic process engineering operations required for the generation and purification of the target product are connected in series. The preconfigured single-use systems, which consist of tubing, disposable tanks, pump pots, and filtration or chromatography modules, are self-contained. Sterile connection technologies, usually tubing connections, are therefore required to connect two successive process steps.

On the one hand, there are mechanical one-way couplings, on the other hand, there are devices with which thermoplastic hoses can be sterilely welded together or existing connections can be cut and the hose ends welded. Special quick transfer systems have been developed for connections through a wall. At present, most production processes in which disposables are used are still so-called hybrid processes in which disposable systems are combined with conventional systems made of stainless steel and glass. A distinction is made here between closed systems, in which the single-use systems are coupled together in the sequence of the process steps, and station systems, in which the intermediate products are transported to the next process step by means of mobile containers.

In biopharmaceutical production, the term "single use" (often also referred to as "disposable") defines an item that is intended for single use. Usually, this consists of a plastic material, such as polyamide (PA), polycarbonate (PC), polyethylene (PE), polyether sulfone (PESU), polyoxymethylene (POM), polypropylene (PP), polytetrafluoroethylene (PTFE), polyvinyl chloride (PVC), cellulose acetate (CA) or ethylene vinyl acetate (EVA), and is disposed of after its use. Accordingly, single-use technology (SUT) means technology based on single-use systems (SUS).

Figure 13:
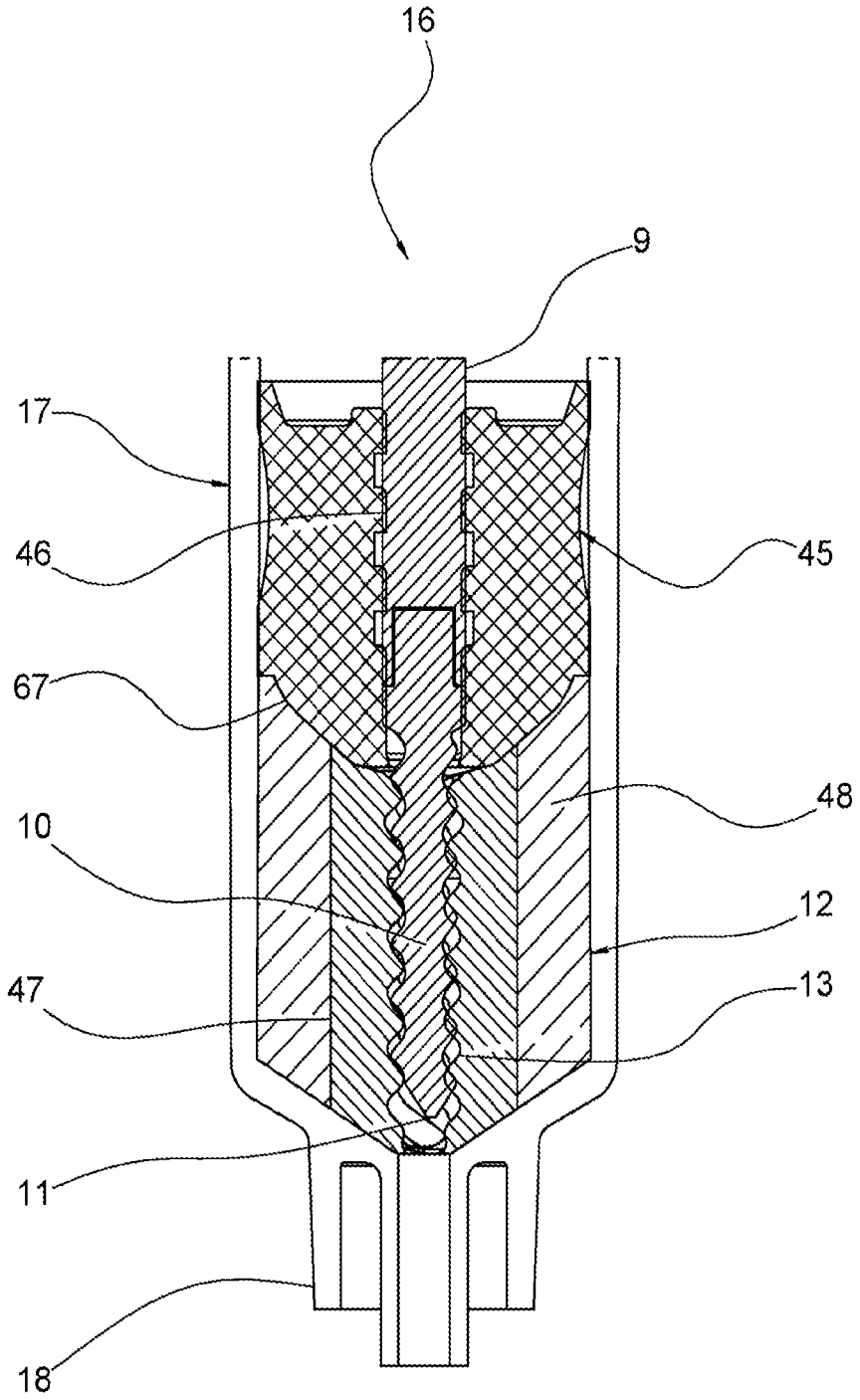
FIG. 13 shows a schematic partial sectional view of an embodiment of a cartridge system for the eccentric screw pump according to FIG. 1.

As shown in FIG. 13, the plug 45 comprises the rotor breakthrough 46 through which the rotor unit 8, in particular the rotor 10, is passed. As FIG. 13 further shows, the stator 12 comprises an inner part 47, in particular an elastomeric part, on which the breakthrough 13 with the helical inner geometry is provided, and an outer part 48 which receives the inner part 47. The outer part 48 is tubular and receives the inner part 47 therein. The inner part 47 is elastically deformable. For example, the inner part 47 may be made of a thermoplastic elastomer (TPE) and the outer part 48 may be made of a polyurethane (PU).

The stator 12 may be an integral component or a multi-piece component. For example, the inner part 47 may be press-fitted into the outer part 48. Alternatively, the inner part 47 and the outer part 48 may be manufactured as a single-piece component using a two-component injection molding process. For example, the elastomeric part 47 is made of a liquid silicone or LSR. The outer part 48 may be made of any thermoplastic material, such as PE, ABS, PP or the like. Alternatively, the elastomeric part 47 may be made of a thermoplastic material.

For example, the stator 12 is inserted, clipped, glued or otherwise connected to the cartridge 17. In particular, as previously mentioned, the stator 12 may be integrally formed with the cartridge 17, in particular formed as one piece of material. However, the stator 12 may also be removable from the cartridge 17.

The air supply 14 can be used to apply an overpressure to the plug 45. A sterile filter or moisture filter can be provided on the air supply 14. This can be provided both inside the bearing housing 5 and outside, for example in the air supply 14.

Figure 14:
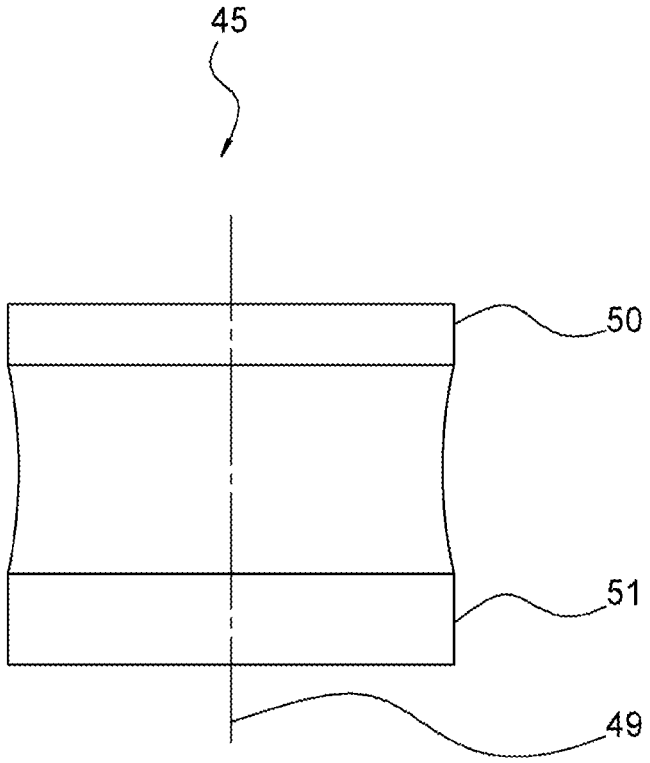
FIG. 14 shows a schematic view of an embodiment of a plug for the cartridge system according to FIG. 13.
Figure 15:
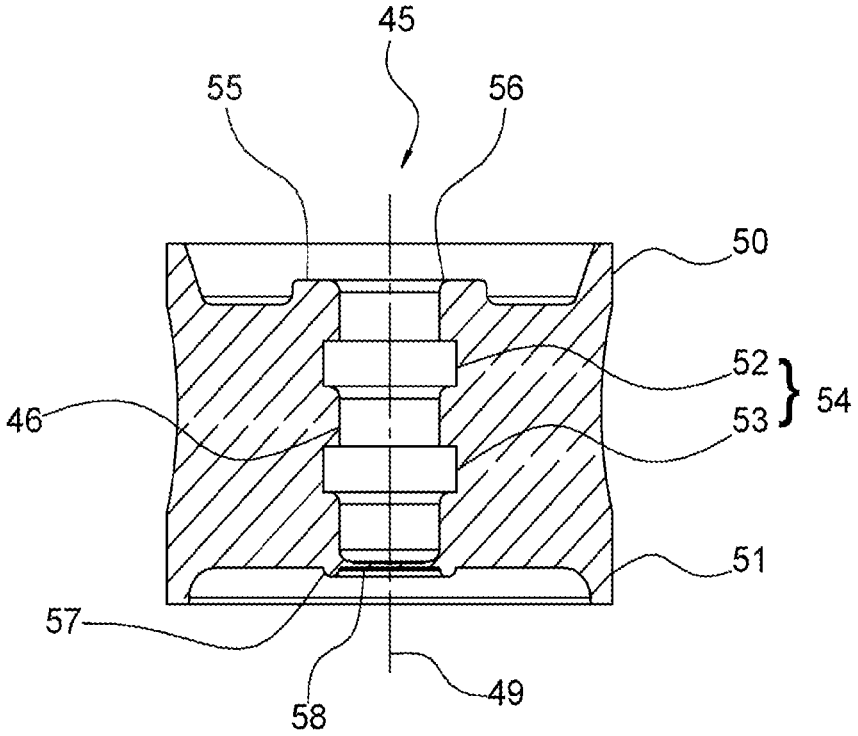
FIG. 15 shows a schematic sectional view of the plug according to FIG. 14.

Returning now to the plug 45, as shown in FIGS. 14 and 15, the plug 45 comprises a cylindrical or roll-shaped geometry. In particular, the plug 45 is rotationally symmetrical about a central axis or axis of symmetry 49. For example, the plug 45 may be made of an LSR, a two-component silicone, PE, POM, PP, PTFE, or an elastomer. The plug 45 may also be made of a porous, open-pored, gas-permeable material, such as PTFE or PE. This allows gas bubbles trapped in the medium to escape through the porous plug 45. The porosity of the material is, for example, in the range from 1 μm to 50 nm, preferably in the range from 10 μm to 50 nm, more preferably in the range from 20 μm to 50 nm. Thus, the medium itself cannot escape through the plug 45. Alternatively, the plug 45 may comprise a built-in membrane.

Facing away from the stator 12, the plug 45 comprises a first sealing lip 50 that runs completely around the axis of symmetry 49. The first sealing lip 50 rests against the inside of the cartridge 17. Averted from the first sealing lip 50, the plug 45 comprises a second sealing lip 51, which also bears against the inside of the cartridge 17. The second sealing lip 51 is placed on the medium side. The first sealing lip 50 is placed facing away from the medium. The second sealing lip 51 has a wiping function and is more rigid than the first sealing lip 50. Viewed along the axis of symmetry 49, the more flexible first sealing lip 50 extends further out of the plug than the second sealing lip 51.

The rotor breakthrough 46 includes a plurality of annular grooves 52, 53 extending around the axis of symmetry 49, which together form a labyrinth seal 54 to provide a fluid-tight seal between the flex shaft 9 and/or the rotor 10 and the plug 45. During an eccentric movement of the flex shaft 9 in the rotor breakthrough 46, displaced plug material is pressed into the annular grooves 52, 53. The number of annular grooves 52, 53 is arbitrary. For example, two such annular grooves 52, 53 may be provided. However, only one annular groove 52, 53 can also be provided.

On the upper side, i.e. facing away from the medium, the plug 45 comprises a stiffening ring 55 extending completely around the axis of symmetry 49, which is pierced by the rotor breakthrough 46. A rounding 56 is provided in a transition between the stiffening ring 55 and the rotor breakthrough 46, which facilitates insertion of the rotor unit 8 into the rotor breakthrough 46.

Facing the medium, i.e. away from the stiffening ring 55, a pressure ring 57 is provided. The pressure ring 57 constricts around the rotor unit 8 and seals against it. The pressure ring 57 has the shape of a halved O-ring. The rotor breakthrough 46 is closed by means of a membrane 58, which is connected to the pressure ring 57. The membrane 58 can be pierced by means of the rotor 10, in particular by means of the tip 11 of the rotor 10. The pressure ring 57 ensures that the plug 45 does not tear further when the membrane 58 is pierced.

Figure 16:
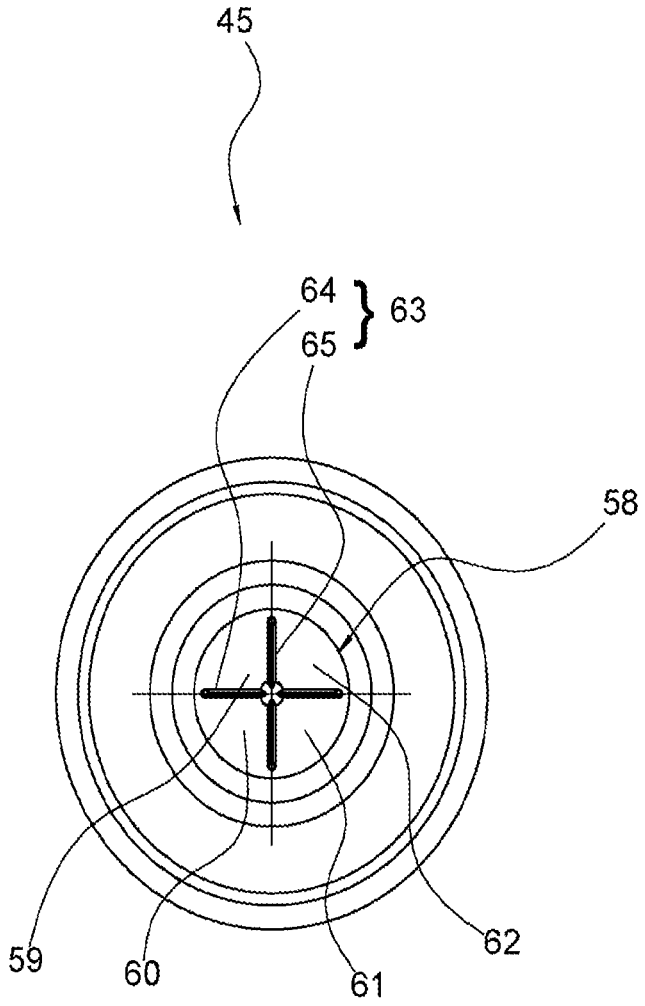
FIG. 16 shows a schematic bottom view of the plug according to FIG. 14.

As shown in FIG. 16, the membrane 58 includes a plurality of membrane sections 59 to 62. The number of membrane sections 59 to 62 is arbitrary. For example, two, three or four membrane sections 59 to 62 may be provided. A perforation 63 is provided between the membrane sections 59 to 62, which is cross-shaped. The perforation 63 includes a first perforation section 64 and a second perforation section 65, which are placed perpendicular to each other and form the cross-shaped perforation 63. By providing the perforation 63, parts of the membrane 58 can be prevented from detaching when the membrane 58 is pierced by the rotor 10.

The plug 45 seals both at the first sealing lip 50 and at the second sealing lip 51 with an overlap. This means that the sealing lips 50, 51 are radially compressed in the cartridge 17. At the same time, a wiping function is realized on the side of the medium and on the inside of the cartridge 17.

The plug 45, or the material used for the plug 45, may include an indicator that changes state when the plug 45 is used or has been used for a period of time. For example, the indicator may be a dye. That is, the plug 45 changes color with a single use. For example, the plug 45 may change color upon contact with air or moisture or the medium. For example, the plug 45 changes color after a period of time, such as eight hours.

Figure 17:
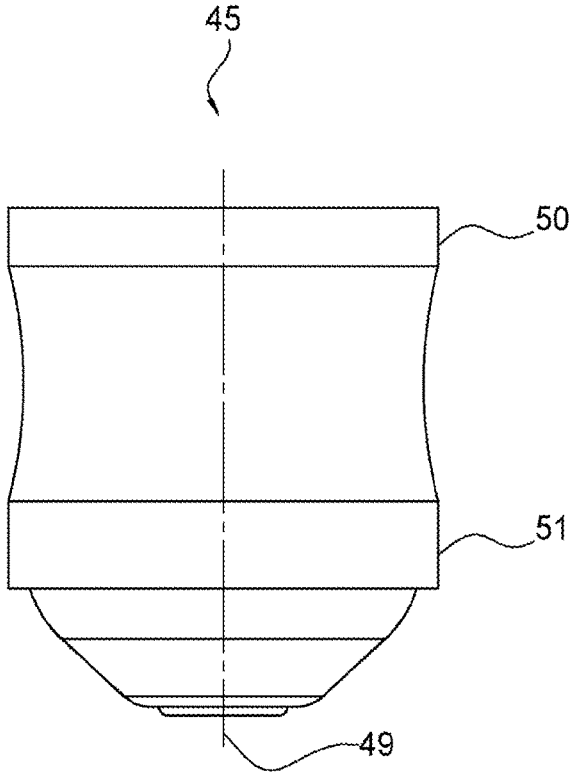
FIG. 17 shows a schematic view of a further embodiment of a plug for the cartridge system according to FIG. 13.
Figure 18:
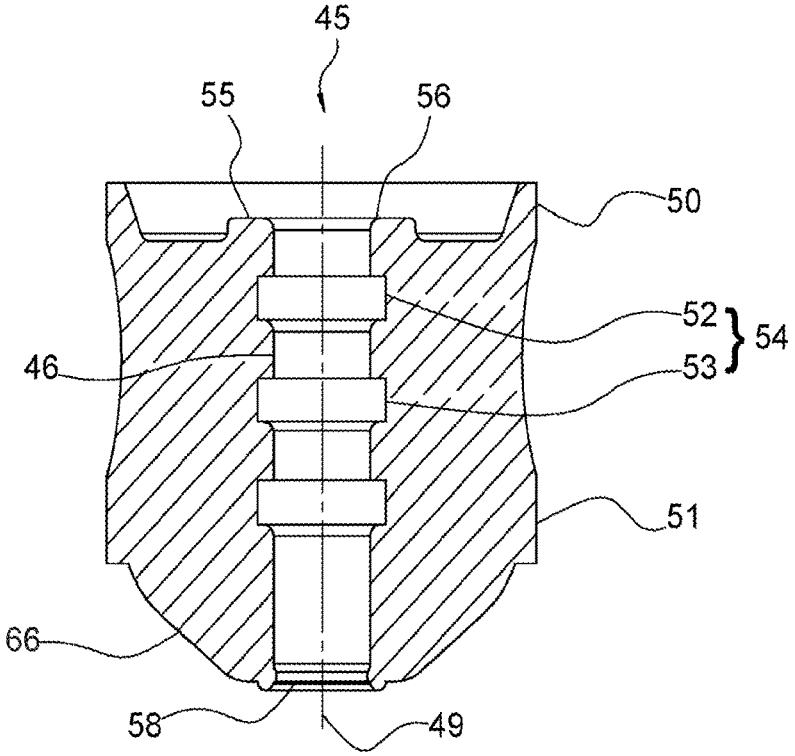
FIG. 18 shows a schematic sectional view of the plug according to FIG. 17.

FIGS. 17 and 18 show another embodiment of a plug 45. The plug 45 according to FIGS. 17 and 18 is particularly suitable for low to medium viscosity media. As previously mentioned, the plug 45 comprises two sealing lips 50, 51. In contrast to the plug 45 according to FIGS. 14 to 16, the plug 45 according to FIGS. 17 and 18 comprises three annular grooves 52, 53, of which only two are provided with a reference sign in FIG. 18. Facing the medium, the plug 45 comprises a cone section 66 bulging out of the plug 45. When using the plug 45 according to FIGS. 17 and 18, the stator 12 has a cone-shaped geometry corresponding to the cone section 66 of the plug 45, in particular a counter cone section 67, as shown for example in FIG. 13.

Figure 19:
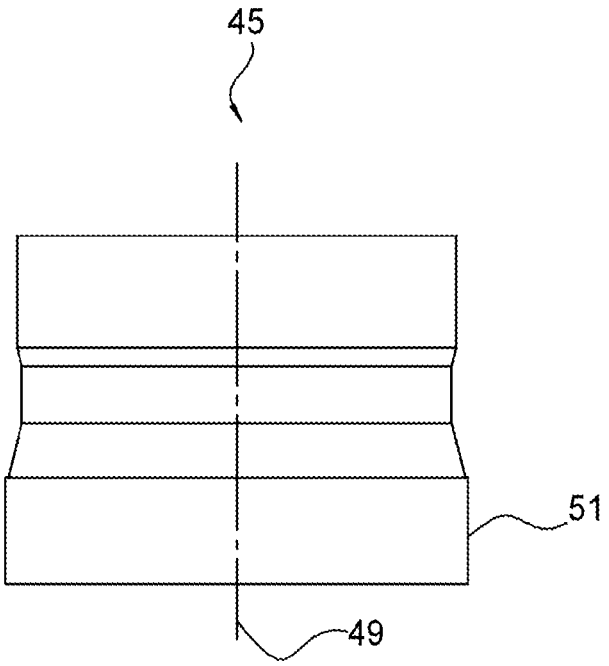
FIG. 19 shows a schematic view of a further embodiment of a plug for the cartridge system according to FIG. 13.
Figure 20:
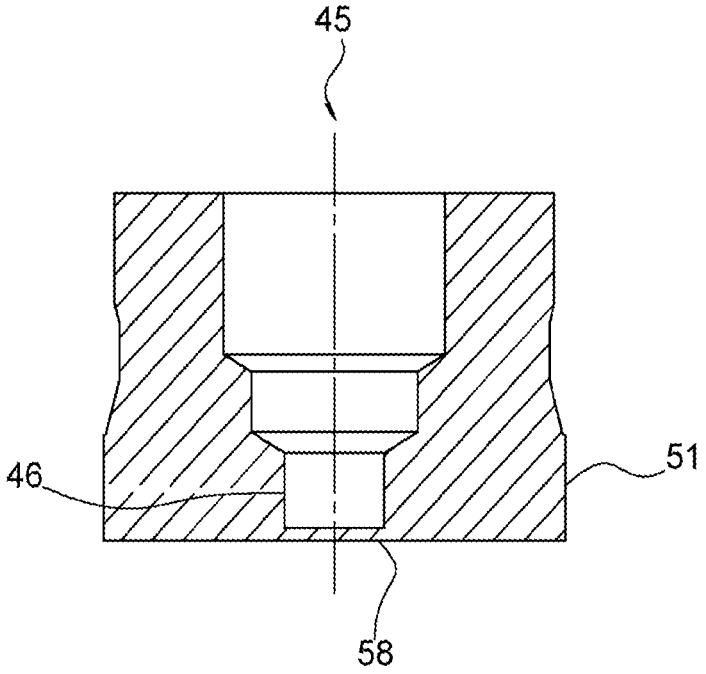
FIG. 20 shows a schematic sectional view of the plug according to FIG. 19.

FIGS. 19 and 20 show a further embodiment of a plug 45. In contrast to the previously explained plugs 45, the plug 45 according to FIGS. 19 and 20 comprises only one sealing lip 51 facing the medium. Furthermore, no annular grooves 52, 53 as previously mentioned are provided at the rotor breakthrough 46. The plug 45 according to FIGS. 19 and 20 is particularly suitable for low- to high-viscosity media. However, the plug 45 is particularly preferably suitable for highly viscous media. In this case, the rotor breakthrough 46 is designed as a stepped bore.

Figure 21:
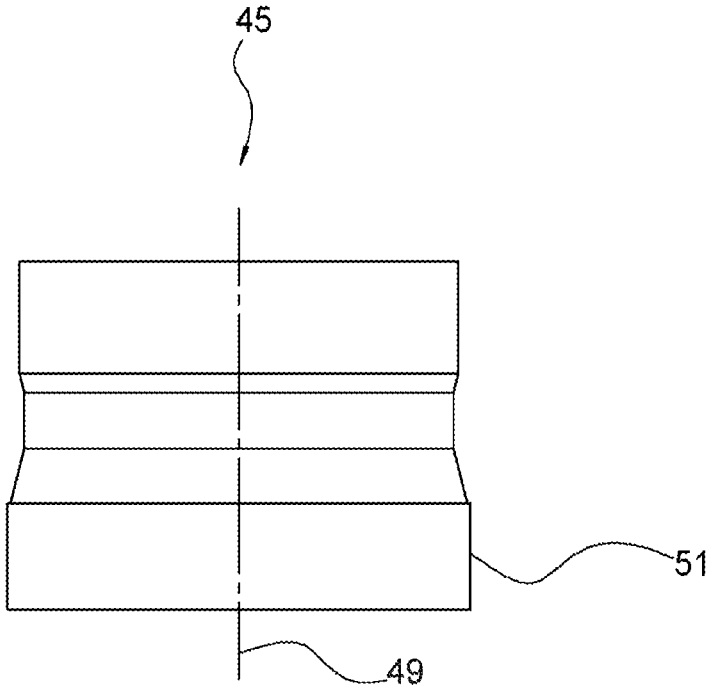
FIG. 21 shows a schematic view of a further embodiment of a plug for the cartridge system according to FIG. 13.
Figure 22:
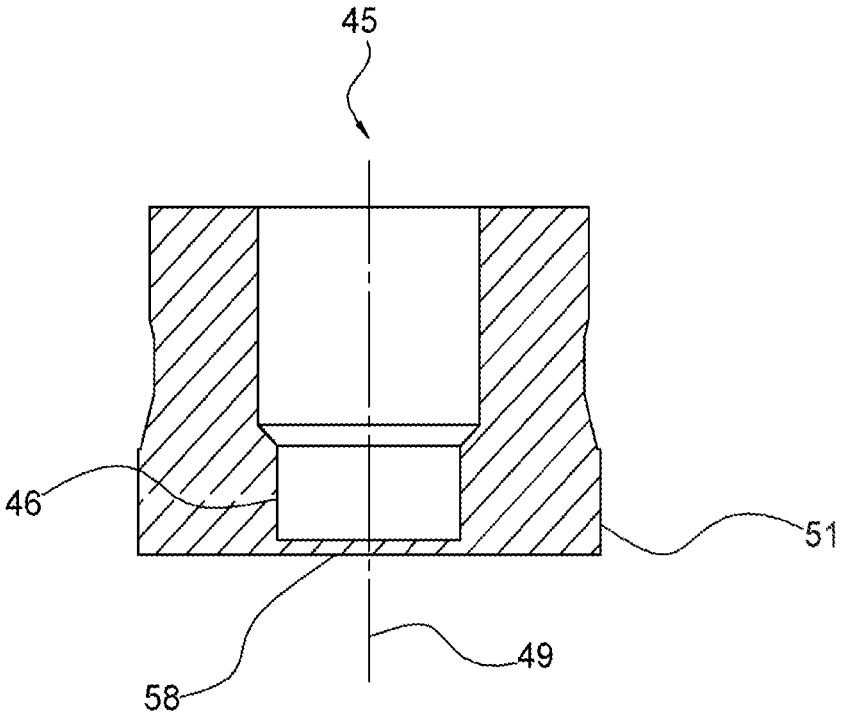
FIG. 22 shows a schematic sectional view of the plug according to FIG. 21.

FIGS. 21 and 22 show a further embodiment of a plug 45. The plug 45 according to FIGS. 21 and 22 is particularly suitable for low- to high-viscosity materials. The plug 45 according to FIGS. 21 and 22 differs from the plug 45 according to FIGS. 19 and 20 in that the rotor breakthrough 46 is designed in such a way that the plug 45 is in contact with the plug 45 only in the region of the thin-walled membrane 58. The plug 45 comprises only one circumferential sealing lip 51 facing the medium. In this case, the plug 45 is preferably made of a particularly elastic material.

In particular, the eccentric screw pump 1 can be used for additive or generative manufacturing. That is, the eccentric screw pump 1 is, or may be designated as, a 3D print head. 3D printing is a comprehensive term for all manufacturing processes in which material can be applied layer by layer to create three-dimensional objects. In this process, the layer-by-layer build-up is computer-controlled from one or more liquid or solid materials according to specified dimensions and shapes.

Physical or chemical hardening or melting processes take place during the buildup. Typical materials for 3D printing are plastics, synthetic resins, ceramics and metals. Meanwhile, carbon and graphite materials have also been developed for 3D printing parts made of carbon. Although it is a preforming process, it does not require special tools that have stored the particular geometry of the part, such as molds, for a specific product. 3D printers are used in industry, model making and research to produce models, samples, prototypes, tools, final products or the like. Furthermore, they are also used for private use. In addition, there are applications in the home and entertainment sector, the construction industry, as well as in art and medicine.

These processes are used for the parallel production of very small components in large quantities, for unique pieces of jewelry or in medical and dental technology, both in small batch production and in the one-off production of parts with a high level of geometric complexity, also with additional functional integration. In contrast to primary forming, forming or subtractive manufacturing processes, such as cutting, the economic efficiency of 3D printing increases as the complexity of the component geometry increases and the number of pieces required decreases. In recent years, the areas of application for these manufacturing processes have been expanded to include other fields. Initially, 3D printers were used primarily for the production of prototypes and models, then for the production of tools, and finally for finished parts of which only small quantities are required.

Some fundamental advantages over competing manufacturing processes are leading to an increasing spread of the technology, also in the series production of parts. Compared to injection molding, 3D printing has the advantage of eliminating the need for time-consuming mold making and mold changing. Compared to all material-removing processes, such as cutting, turning, drilling or the like, 3D printing has the advantage of eliminating additional processing steps after the original mold. In most cases, the process is more energy efficient, especially if the material is built up only once in the required size and mass. However, as with other automated processes, post-processing may be necessary depending on the application.

Further advantages are that different components can be manufactured on one machine and complicated geometries can be created. The use of the eccentric screw pump 1 for 3D printing is an extrusion-based process. The eccentric screw pump 1 can be used, for example, to process silicones, polyurethanes, ceramic and metal pastes, epoxy resins and acrylates.

The advantages over other technologies capable of printing liquids are the applicability for high viscosities, the high precision and process stability, the large usable material spectrum and the high application speed. Other technologies rely on sometimes severe material adjustments to accomplish a useful printing process. Light-based technologies for liquids, for example, are always dependent on the presence of a photon crosslinker, whereas the eccentric screw pump 1 can print completely independently of the curing mechanism.

In particular, the eccentric screw pump 1 can be used for so-called bioprinting. The application area of bioprinting is still very young and represents the latest step in cell culture technology. It can be seen as a special form of additive manufacturing at the interface between medical technology and biotechnology. The topic of "bioprinting" is often introduced with words about the great need for donor organs. It is indispensable that tissues and organs are artificially produced in the future to meet the enormous demand. Realistically speaking, this vision is still a long way off, should it ever become reality.

Nevertheless, the use of simpler tissue constructs is moving ever closer. For example, cartilage implants or replicated skin sections for faster wound care are conceivable. Bone waxes and bone substitute materials are also possible. Customized bone implants made of body-compatible materials are already in use. However, this is not to be regarded as bioprinting in the narrower sense, since no biological materials are used.

Great potential can be seen in the research field of "drug discovery. Here, knowledge about the side effects and interactions of various active ingredients can be gained within a very short time. For this purpose, "mini-organs" are printed that can reproduce all the essential functions of a normal organ. Using microfluidic techniques, these mini-organs can be combined to form multi-organ systems, allowing the systemic effects of active ingredients to be tested without the need for animal experiments.

In bioprinting, the eccentric screw pump 1, in particular a bioprinter, is used to generate cell-loaded gels or matrices for the preservation and cultivation of the same. This is done by a layer-by-layer structure, which is known from additive manufacturing. Since most of the media in bioprinting are loaded with living cells, which can only be produced at considerable time and cost, gentle dispensing is essential. Stress on the dispensed cells increases with cell density and viscosity in the media. However, the highest possible cell density and stability are required for useful constructions. Thus, a tension arises between cell concentration and application technology.

The special feature of the eccentric screw pump 1 is the design of the cartridge system 16 as a disposable item. In this case, the cartridge system 16 containing the stator 12 is replaced after a single use. The drive device 2 itself remains. Necessary in this case is also an exchange of the plug 45, which is part of the cartridge system 16. It is also possible to replace the rotor 10, in case it is part of the cartridge system 16.

The use of the cartridge system 16 as a single-use printhead has many advantages over established methods. High precision and resolution can be achieved during application. Process fluctuations are compensated and enable consistent and reproducible printing results. Environmental parameters are leveled. Low- to high-viscosity media can be conveyed without damaging the product. There is no clogging of a dosing needle.

There is no compromise between cell-protecting application and precision. The application can be carried out without pulsation. Active withdrawal of medium into the cartridge system 16 is possible to prevent filament formation or dripping. Hygienic implementation or sterilization enables a contamination-free process. This is ensured by the single use. A low dead volume allows almost complete extrusion of the medium. Easy integration into existing bioprinters is possible. The design does not require a separate control system and is geometrically optimized for bioprinters. Easy handling without additional tooling is possible.

With the aid of the plug 45, it is possible both to seal off the interior space 19 of the cartridge 17 from the environment and to protect the drive unit 3 from contamination with medium. The fact that the medium is not supplied via a hose or pipe line, but is accommodated directly in the cartridge system 16, means that the dead volume can be reduced, since the medium is very costly and even the smallest quantities are too valuable to be lost as dead volume. A loss-free feed and an at least almost complete emptying of the cartridge system 16 is ensured.

Since the cartridge system 16 is a disposable item, it can be easily sterilized. Because the cartridge system 16 is replaceable, cleaning of the drive device 2 itself is not necessary. Thus, it is not necessary to completely disassemble the drive device 2 in order to clean the eccentric screw pump 1. The cartridge system 16 can be changed very easily and quickly, which means that the eccentric screw pump 1 is ready for use again in a very short time.

Biological media are usually dispensed in a working range of +4° C. to +40° C., since most cells are only viable in a narrow temperature range. The media to be printed are very often subject to a temperature-controlled gelation mechanism, which ensures dimensional stability during printing. This requires precise temperature control. Cooling is equally important to ensure that some cell types do not die and that certain gels can be printed.

With the aid of the eccentrically sealing plug 45, it is possible to seal off the medium from the interior space 19. This results in freedom from contamination and ensures that sensitive components, for example the drive unit 3, are protected. The plug 45 not only serves to seal, but also fulfills the function of transmitting force to the medium in order to provide a pre-pressure for dosing the same. This pre-pressure can be applied, for example, by compressed air supplied via the air supply 14 or by a spring.

Figure 23:
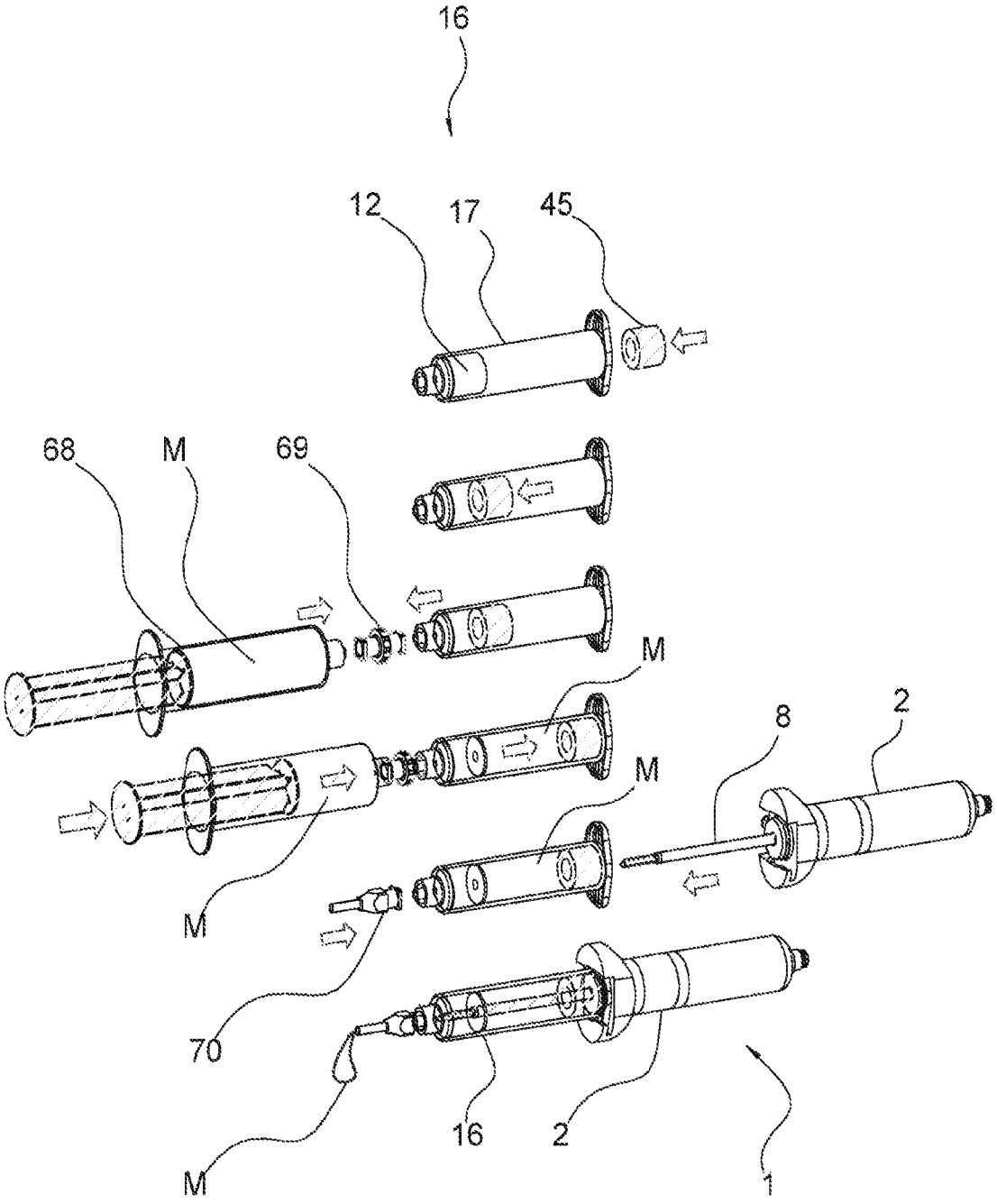
FIG. 23 shows a schematic perspective view of an embodiment of a filling concept for filling the cartridge system according to FIG. 13.

FIG. 23 schematically shows a filling concept for filling the cartridge system 16. First, the plug 45 is inserted into the cartridge 17. Here, the membrane 58 of the plug 45 faces the stator 12. The plug 45 is pushed into the cartridge 17 until the plug 45 rests against the stator 12.

A syringe 68 filled with a medium M is then connected to the Luer lock connection 18 of the cartridge 17 via an adapter 69. The cartridge system 16 is now filled with the medium M, with the plug 45 moving away from the stator 12. Once the cartridge system 16 is filled with the medium M, the cartridge system 16 is connected to the drive device 2. In this process, the membrane 58 is pierced by the rotor 10. Furthermore, a nozzle 70 is attached to the Luer lock connection 18. By means of the bayonet lock 27, the cartridge system 16 is connected to the drive device 2. Dosing of the medium M can now be started.

To fill the cartridge 17 and to protect the medium M against the environment, it is necessary for the plug 45 to be closed. This is solved by providing the plug 45 with the perforable membrane 58 in the center. This should still be tight after the filling process of the cartridge system 16, when the rotor 10 pierces the membrane 58 from above. Furthermore, the plug 45 must allow the eccentric movement of the rotor 10 during the complete emptying duration of the cartridge system 16 and still remain tight. This is achieved by an appropriate choice of material for the plug 45.

In order to eliminate the dead space to a large extent, it is necessary that the medium M can remain in as few depressions, cavities or undercuts as possible. It is therefore well suited to have an inner geometry of the cartridge 17 that is as simple as possible and in contact with the product. For this reason, the cartridge 17 is also cylindrical on the inside. The potential disadvantage that the rotor 10 must be guided through the center of the cartridge 17 and thus medium M can potentially stick to the rotor unit 8 is compensated for by the stripping function of the plug 45. Optimal residual emptying is achieved by a tapered stator 12 and a correspondingly shaped plug 45, as also shown for example in FIGS. 13 and 18.

It is difficult to completely clean and sterilize a progressing cavity pump while taking into account its feasibility in everyday laboratory use. However, this problem can be solved by introducing the cartridge system 16 as a single-use item. The single use of the pump parts essential for dosing guarantees absolute safety with regard to sterility and freedom from contamination. All parts in contact with the product can be replaced after a single use, i.e. after a single emptying of the cartridge system 16. Both the stator 12, which is firmly connected to the cartridge 17, as well as the rotor 10 and the plug 45 can be replaced.

To ensure single use, the following measures can be applied. The rotor-stator combination can be designed for a low dosing volume until failure occurs. The plug 45 may be irreversibly destroyed after single use, for example by puncturing the membrane 58. It is possible to snap the rotor 10 into the cartridge 17 so that it cannot be separated from the cartridge system 16. It is possible to have an irreversible closure of the cartridge 17, so that the damaged plug 45 cannot be replaced. Furthermore, a color indication is possible, which indicates a single use.

The handing of the cartridge system 16 is simplified to such an extent that a user only has to fill the cartridge system 16, insert the rotor unit 8 into the drive device 2 and tighten the cartridge system 16 on the drive device 2. Disassembly and reassembly are possible without tools. The cartridge system 16 can be filled, operated and replaced in a sterile manner without leaving any residue. After use, the rotor 10, in particular the rotor unit 8, is automatically removed along with the cartridge system 16 when it is pulled off the drive device 2. Handing is thus largely the same as for a regular cartridge. The extrusion is controlled by stepper motor signals from a controller. No separate controller is required, which improves handing in practice.

In order to be able to use the eccentric screw pump 1 in existing 3D printers, a reduction in weight and size is desirable. The greatest savings are possible by selecting a suitable drive unit 3. Since the seal of the drive unit 3 does not have to withstand high pressures, it can be made smaller. The materials for the drive device 2 are selected so that they are as light as possible. The housing 4 can be made partly of metal or of plastic. Since the components rotor 10, stator 12, plug 45 and cartridge 17 are made of plastic, the weight is further reduced.

The temperature regulation of the medium M can be carried out via an external element which can be plugged onto the cartridge system 16. The cooling or heating takes place directly on an outer surface of the cartridge 17 and can be kept constant over the entire length of the cartridge 17 via an adapted shape. There is no thermal bridge between the drive unit 3 and the cartridge system 16, which means that the increase in motor temperature does not directly affect the cartridge contents. This is implemented firstly by the relatively large distance between the drive unit 3 and the cartridge system 16, and secondly by a suitable choice of material. Plastic prevents conduction from the drive unit 3 to the medium M. Metal provided on the drive unit 3 promotes heat dissipation to the surroundings.

In addition to the use of the eccentric screw pump 1 in the field of bioprinting, other areas of application are also conceivable. In additive manufacturing, the use of the eccentric screw pump 1 does not have to be limited to bioprinting. Printing of materials such as silicones, epoxy resins, polyurethanes, ceramic, metal and solder pastes is also possible. With a compact design, it is also conceivable to open up the market for amateur 3D printers.

Another possible application is the printing of meat substitutes. Here, strict hygiene regulations also apply. Many different materials are used, and the viscosity can be very high. It is irrelevant whether the substitute products were generated directly via animal sources or are replicated or replaced by plant sources.

Furthermore, use in the chemical industry is also possible. Some chemicals are generally not suitable for printing with eccentric screw pumps due to their tendency to stick together. Cyanoacrylates, for example, pose a problem, as these harden in the presence of moisture and can completely destroy the eccentric screw pump. A closed system in the form of the cartridge system 16 explained above, which can be quickly replaced without major damage in the event of a malfunction, is advantageous.

The use of the cartridge system 16 is also useful in a laboratory environment where small quantities are tested and rapid product changes take place. For example, if different formulations of an adhesive compound are tested, the entire eccentric screw pump would always have to be disassembled and cleaned without such a cartridge system 16. Since the sterility requirements for adhesives are not given, it would also be conceivable to change only the cartridge 17 and not the rotor unit 8. Different cartridge sizes ensure usability in different areas.

In medical technology, one conceivable application would be as a hand applicator. The cartridge system 16 can be used for precise application of material in wound care, in the body, during operations, in dental treatments or for dispensing medications. One interface of additive manufacturing and medical technology is, for example, the printing of tablets. By individually creating tablets with patient-specific active ingredients and active ingredient contents, problems with interactions, overdosing, underdosing and forgetting to take the medication can be counteracted. The eccentric screw pump 1 can also be used for printing tablets.

Figure 24:
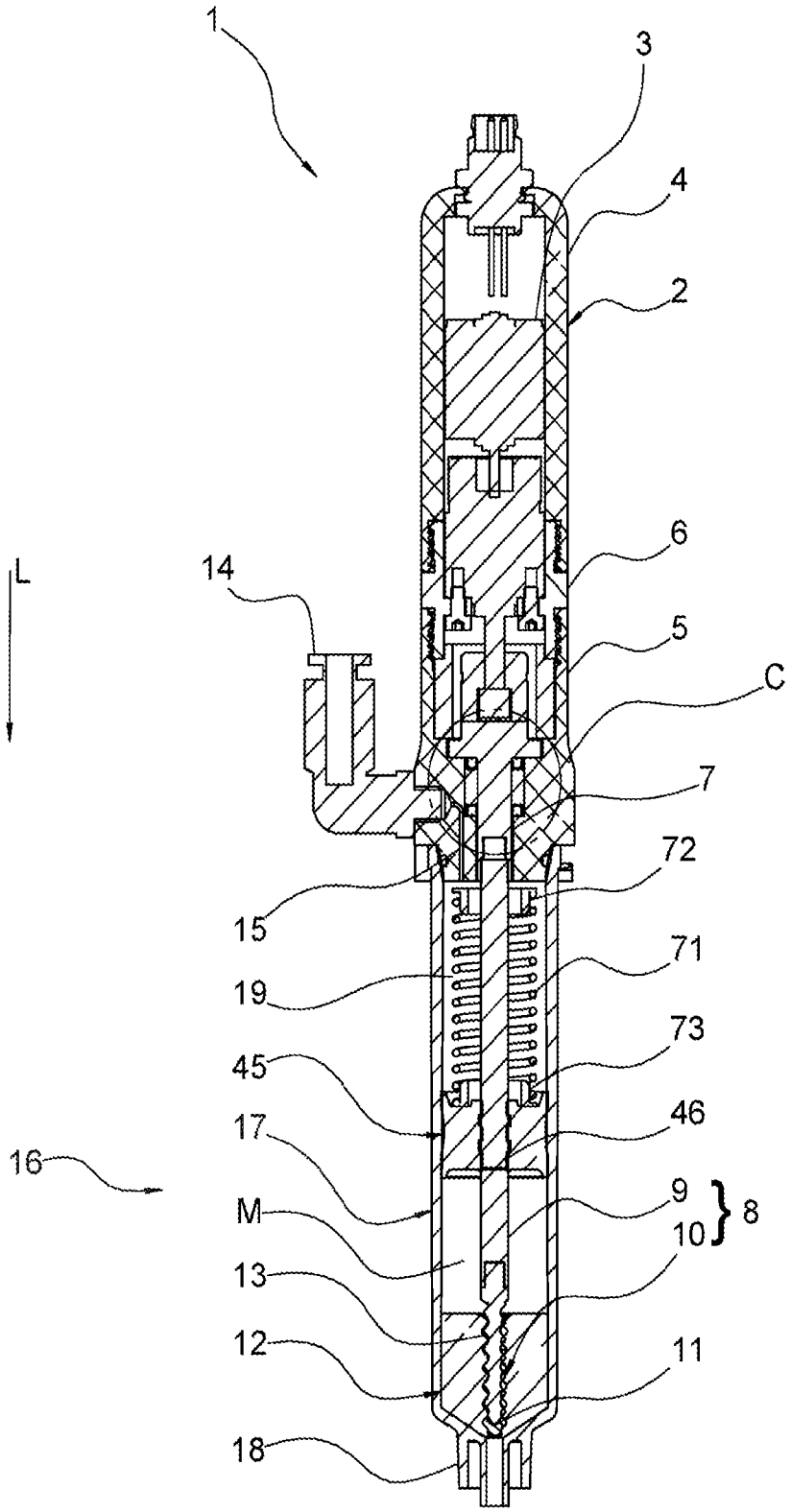
FIG. 24 shows a schematic sectional view of a further embodiment of an eccentric screw pump.
Figure 25:
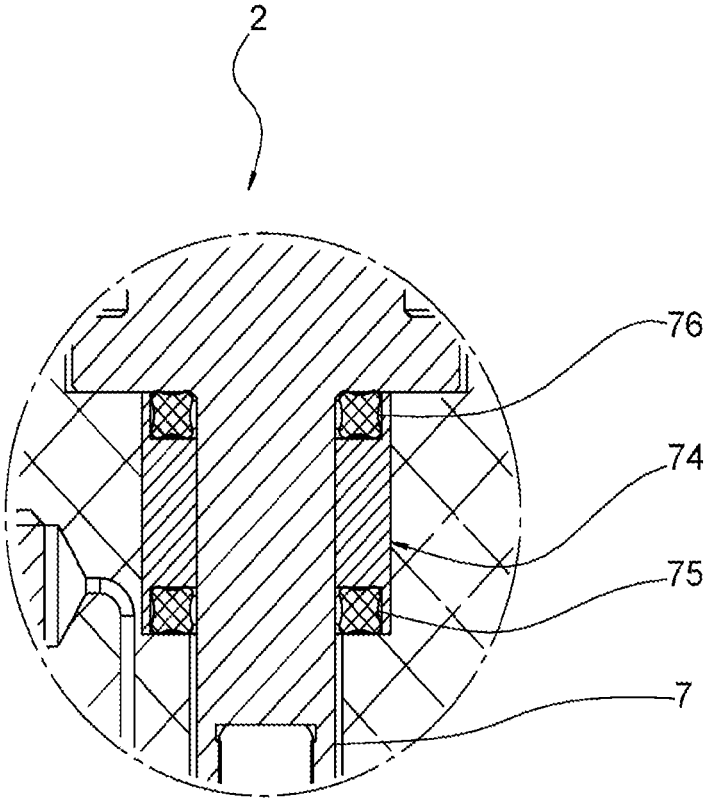
FIG. 25 shows the detailed view C according to FIG. 24.

FIG. 24 shows a schematic sectional view of a further embodiment of an eccentric screw pump 1. FIG. 25 shows the detailed view C according to FIG. 24. The eccentric screw pump 1 according to FIG. 24 differs from the eccentric screw pump 1 according to FIGS. 1 and 2 only in that the cartridge system 16 has a spring element 71, which is arranged between the plug 45 and the bearing housing 5. Annular pressure pieces 72, 73 are provided on both sides of the spring element 71. In addition, pressurization is still possible via the air supply 14. The interior space 19 of the cartridge 17 can also be subjected to a negative pressure, in particular a vacuum.

In contrast to the eccentric screw pump 1 according to FIGS. 1 and 2, instead of pressurizing the plug 45 with air, this task is performed by the spring element 71. The spring element 71 comprises a linear characteristic. The force exerted on the plug 45 can, on the one hand, be applied via air pressure, with the aid of a spring force of the spring element 71 or with the aid of a spindle drive which is not shown. In the latter case, an eccentric insert is provided in the plug 45. The pitch of this eccentric insert is adapted to the volumetric quantity and thus also to the plug speed. In other words, the plug 45 is positively driven.

As shown in FIG. 25, a sliding bushing 74 is provided for supporting the drive shaft 7 in the bearing housing 5. The sliding bushing 74 comprises a first sealing ring 75 and a second sealing ring 76. Only one sealing ring 75, 76 can also be provided. The sealing ring 75 seals against a vacuum in the interior space 19.

Figure 26:
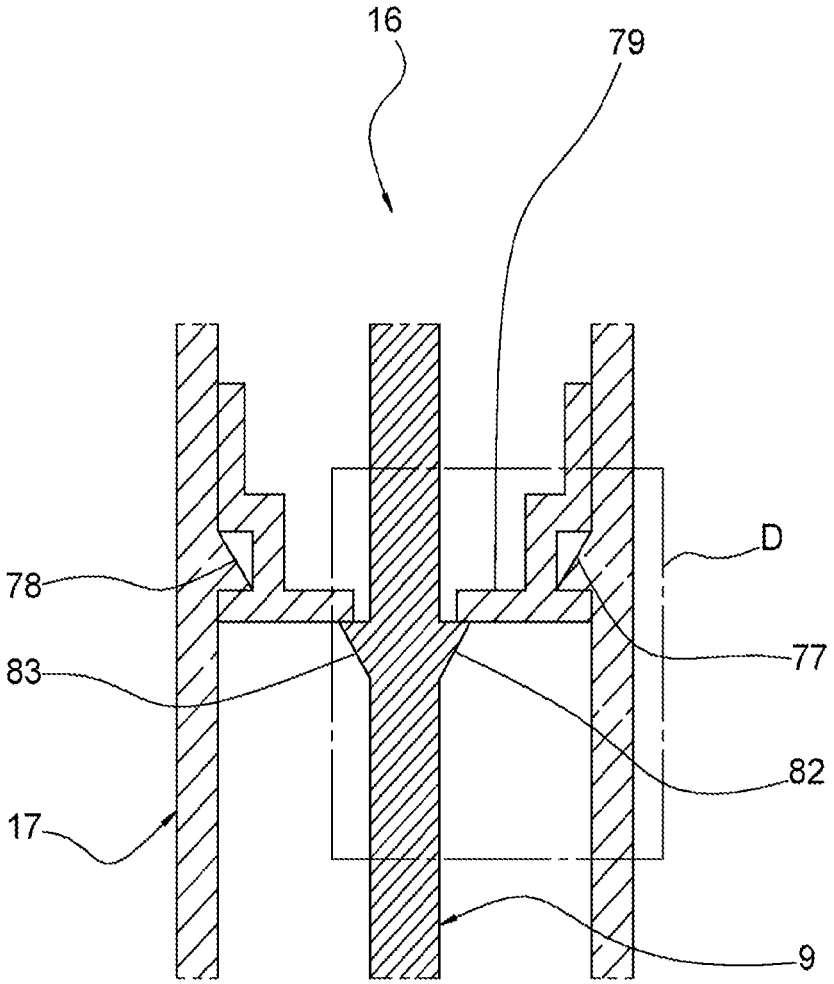
FIG. 26 shows a schematic partial sectional view of a further embodiment of a cartridge system for the eccentric screw pump according to FIG. 1 or FIG. 24.
Figure 27:
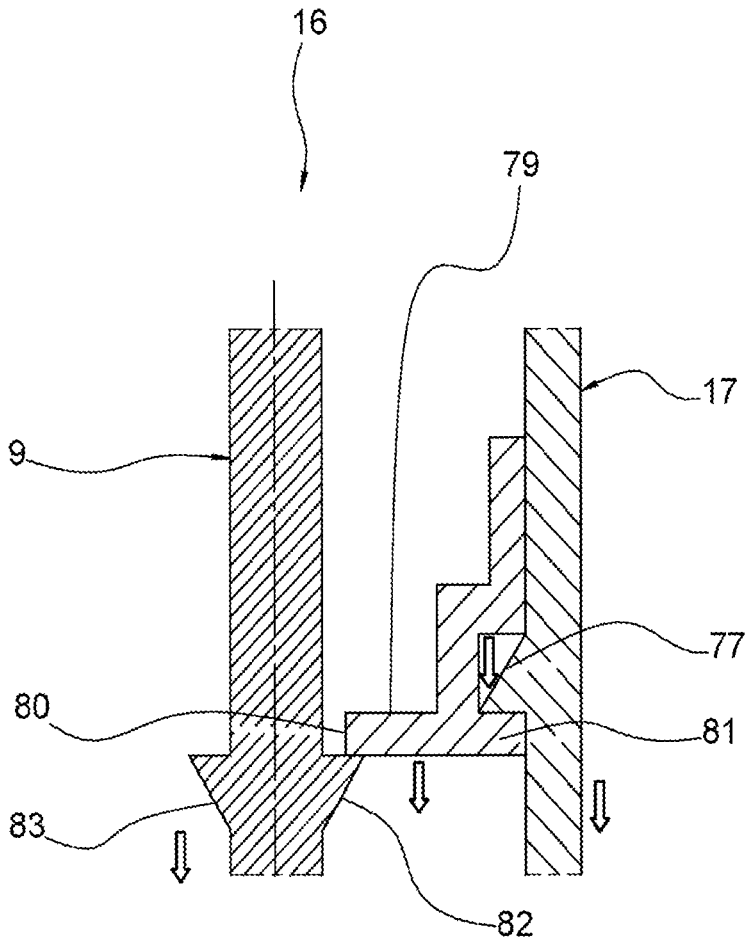
FIG. 27 shows the detailed view D according to FIG. 26.

FIG. 26 shows a schematic sectional view of a further embodiment of a cartridge system 16. FIG. 27 shows the detailed view D according to FIG. 26. In this further embodiment of the cartridge system 16, latching hooks or latching hooks 77, 78 are provided on the inside of the cartridge 17. Furthermore, a lid 79 closing the cartridge 17 is provided. The lid 79 may be plate-shaped and includes a central breakthrough 80 through which the rotor unit 8 passes. The lid 79 includes a circumferential engagement section 81 which engages behind the latching hooks 77, 78. That is, the lid 79 can be pressed into the cartridge 17, as indicated by arrows in FIG. 27, with the engagement section 81 engaging behind the latching hooks 77, 78. The lid 79 can now no longer be separated from the cartridge 17.

Snap-in hooks or latching hooks 82, 83 can be provided on the rotor unit 8, in particular on the flex shaft 9. The number of latching hooks 82, 83 is arbitrary. The latching hooks 82, 83 can engage behind the lid 79. In particular, the latching hooks 82, 83 project radially further out of the rotor unit 8 than a diameter of the breakthrough 80 is large. The rotor unit 8 can be passed through the breakthrough 80. As soon as the latching hooks 82, 83 have passed through the breakthrough 80, these snap into place behind the lid 79. Now the rotor unit 8 can also no longer be separated from the cartridge system 16.

That is, the cartridge system 16 and all components of the cartridge system 16 can actually be used only once. Alternatively, however, the rotor unit 8 and the plug 45 could be cleaned and reused several times. However, the lid 79 can at least ensure that the cartridge 17 is used only once. Advantage here can be seen in the case of single use or contamination, for example in the case of toxic or carcinogenic agents, as well as for cleaning and self-protection.

Figure 28:
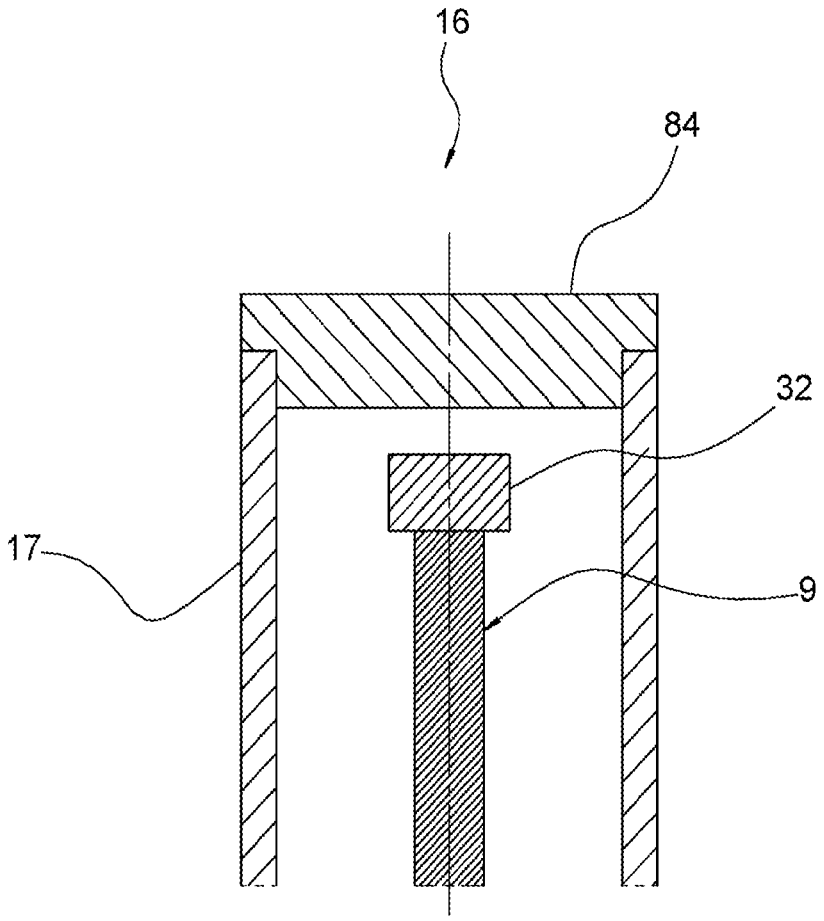
FIG. 28 shows a schematic partial sectional view of a further embodiment of a cartridge system for the eccentric screw pump according to FIG. 1 or FIG. 24.

FIG. 28 shows a schematic sectional view of a further embodiment of a cartridge system 16. The cartridge system 16 according to FIG. 28 is completely encapsulated. For this purpose, a lid 84 is provided on the rear side of the cartridge 17. The lid 84 is bonded or fused to the cartridge 17, for example. The lid 84 is connected to the cartridge 17 in a fluid-tight manner.

The cartridge system 16 is thus completely encapsulated and comprises, in addition to the cartridge 17, the stator 12, the rotor unit 8 and the plug 45 (not shown). The interface 32 of the rotor unit 8, in particular of the flex shaft 9, is designed here as a non-contact interface. In particular, the interface 32 is provided on the flex shaft 9. Accordingly, a corresponding counter interface is provided on the drive device 2. The interface 32 can, for example, be a magnetic coupling or part of a magnetic coupling.

In principle, all embodiments of the cartridge system 16 or the cartridge 17 can have an RFID chip (Radio Frequency Identification). This can be used in particular to recognize a geometry of the stator 12, for example in order to be able to assign the matching rotor 10 to the stator 12. Size recognition is thus possible, for example. Furthermore, batch recognition of the medium M contained in the cartridge 17 is also possible.

The cartridge system 16 or the cartridge 17 can also have a QR code (Quick Response), which is lasered into the cartridge 17, for example. This can be used, for example, to identify the medium M contained in the cartridge 17. Information can then be read out, for example, which allows conclusions to be drawn about the contents of the cartridge 17, namely the medium M. For example, batch recognition, a statement about the service life or shelf life of the medium M, product tracking or the like is possible.

The eccentric screw pump 1 can be mains-operated or battery-operated. This means that battery operation of the drive unit 3 is possible. This makes the eccentric screw pump 1 independent of a power supply system. The eccentric screw pump 1 can thus operate autonomously as a hand-held device. For example, the eccentric screw pump 1 can thus be used for dosing solder paste at a manual workstation. The eccentric screw pump 1 can thus be used in the manner of a pipetting device or pipetting aid, with the difference that highly viscous media M can also be dosed with the aid of the eccentric screw pump 1. Furthermore, such a self-sufficiently operating eccentric screw pump 1 can also be used for rapid wound care, for example for field care of emergency personnel, in medical practices or in the operating room. In this case, for example, waxes, in particular bone waxes, adhesives, medications, dental prosthesis materials, artificial skin or the like can be dosed.

Although the present invention has been described with reference to examples of embodiments, it can be modified in a variety of ways.

The invention claimed is:

1. A cartridge system comprising:

a cartridge for receiving a medium to be dosed, a stator being provided on the cartridge, which cooperates with a rotor unit of an eccentric screw pump for dosing the medium, and a plug being movably supported in the cartridge for a fluid-tight closure of the cartridge, wherein the plug comprises a rotor breakthrough through which the rotor unit can be passed, wherein the rotor breakthrough is closed by means of a membrane facing the stator.

2. The cartridge system according to claim 1, wherein the stator and the cartridge are formed in one piece of material.

3. The cartridge system according to claim 1, wherein the membrane comprises a perforation, wherein the perforation divides the membrane into a plurality of membrane sections.

4. The cartridge system according to claim 1, wherein the plug comprises a pressure ring through which the rotor breakthrough is passed and on which the membrane is provided.

5. The cartridge system according to claim 4, wherein the plug comprises a stiffening ring facing away from the pressure ring, through which the rotor breakthrough is passed.

6. The cartridge system according to claim 1, wherein at least one circumferential annular groove is provided at the rotor breakthrough.

7. The cartridge system according to claim 1, wherein the plug facing away from the stator comprises a circumferential first sealing lip which bears against the inside of the cartridge, and/or wherein the plug facing towards the stator comprises a circumferential second sealing lip which also bears against the inside of the cartridge.

8. The cartridge system according to claim 7, wherein the first sealing lip extends further out of the plug on the face side than the second sealing lip.

9. The cartridge system according to claim 1, further comprising the medium being received in the cartridge.

10. The cartridge system according to claim 1, wherein the plug is made of an air-permeable material.

11. The cartridge system according to claim 1 wherein the cartridge system is exchangeable and detachably connected to a drive device.

12. The cartridge system according to claim 11, wherein the rotor unit is non-detachably connected to the cartridge and/or the plug.

13. The cartridge system according to claim 11, wherein the rotor unit is completely encapsulated by the cartridge.

14. The cartridge system according to claim 11, wherein the rotor unit comprises an interface for coupling the rotor unit to a counter interface of the drive device.

15. The cartridge system according to claim 14, wherein the interface comprises a latching lug that latches into the counter interface when the rotor unit is connected to the drive device.

16. The cartridge system according to claim 15, wherein the interface comprises a plurality of elastically deformable arm sections on which the latching lug is provided.

17. The cartridge system according to claim 1, wherein the stator and the cartridge are connected to each other in a form-fit, force-fit, or material-fit manner.

18. A cartridge system comprising:

a cartridge for receiving a medium to be dosed, a stator being provided on the cartridge, which cooperates with a rotor unit of an eccentric screw pump for dosing the medium, and a plug being movably supported in the cartridge for a fluid-tight closure of the cartridge, wherein the plug comprises a rotor breakthrough through which the rotor unit can be passed, wherein the plug facing away from the stator comprises a circumferential first sealing lip which bears against the inside of the cartridge, and wherein the plug facing towards the stator comprises a circumferential second sealing lip which also bears against the inside of the cartridge, and the second sealing lip comprises a greater stiffness than the first sealing lip.

19. A cartridge system comprising:

a cartridge for receiving a medium to be dosed, a stator being provided on the cartridge, which cooperates with a rotor unit of an eccentric screw pump for dosing the medium, and a plug being movably supported in the cartridge for a fluid-tight closure of the cartridge, wherein the plug comprises a rotor breakthrough through which the rotor unit can be passed, wherein the plug comprises an indicator that changes state after a use of the cartridge system.

* * * * *